US005746027A

United States Patent [19]

Bonerb

[11] Patent Number: 5,746,027

[45] Date of Patent: May 5, 1998

[54] DEVICE AND METHOD FOR REMOVING ICE AND SNOW FROM ROOFS AND OVERHANGS

[76] Inventor: Timothy C. Bonerb, West Side Rd./39 Attitash Woods, Bartlett, N.H. 03840

[21] Appl. No.: 773,909

[22] Filed: Dec. 27, 1996

Related U.S. Application Data

[63] Continuation of Ser. No. 703,642, Aug. 27, 1996.

[60] Provisional application No. 60/010,959 Feb. 1, 1996, provisional application No. 60/016,565 May 3, 1996 and provisional application No. 60/019,745 Jun. 10, 1996.

[51] Int. Cl.[6] ..... E04B 1/62

[52] U.S. Cl. ..... 52/1; 52/11; 52/94; 52/2.13; 52/2.25; 52/741.1; 52/741.3

[58] Field of Search ..... 52/2.11, 2.13, 52/11, 12, 24, 94–97, 741.1, 741.3, DIG. 12

[56] References Cited

U.S. PATENT DOCUMENTS

| | | | |
|---|---|---|---|
| Re. 32,232 | 8/1986 | Bonerb et al. . | |
| 2,111,251 | 3/1938 | Spilsbury | 52/94 |
| 2,651,314 | 9/1953 | Hasselquist . | |
| 2,699,484 | 1/1955 | Michaels | 52/94 X |
| 3,300,910 | 1/1967 | Isaac . | |
| 3,388,730 | 6/1968 | Dery | 52/24 |
| 3,623,684 | 11/1971 | Kline . | |
| 3,690,601 | 9/1972 | Roemke . | |
| 3,832,819 | 9/1974 | Houdin . | |
| 3,958,754 | 5/1976 | Newcomb et al. | 52/2.11 X |
| 4,021,972 | 5/1977 | Choate et al. . | |
| 4,361,298 | 11/1982 | Trares et al. . | |
| 4,399,645 | 8/1983 | Murphy et al. . | |
| 4,449,646 | 5/1984 | Bonerb et al. . | |
| 4,476,998 | 10/1984 | Bonerb et al. . | |
| 4,494,715 | 1/1985 | Weisend, Jr. . | |
| 4,685,254 | 8/1987 | Terreri . | |
| 4,861,215 | 8/1989 | Bonerb . | |
| 4,961,549 | 10/1990 | LaRue . | |
| 5,097,548 | 3/1992 | Heck et al. . | |
| 5,112,011 | 5/1992 | Weisend, Jr. et al. . | |
| 5,160,102 | 11/1992 | Hlavac . | |
| 5,164,242 | 11/1992 | Webster et al. . | |
| 5,170,597 | 12/1992 | Stearns | 52/97 X |
| 5,242,206 | 9/1993 | Heck . | |
| 5,248,116 | 9/1993 | Rauckhorst . | |
| 5,337,978 | 8/1994 | Fahrner et al. . | |
| 5,406,755 | 4/1995 | Serano | 52/12 |
| 5,640,810 | 6/1997 | Pietersen | 52/12 |

OTHER PUBLICATIONS

Flexair, Inc., "Unparalleled Solutions for Handling Dry Bulk Materials", 1990.

*Primary Examiner*—Robert Canfield
*Attorney, Agent, or Firm*—Phillip E. Decker

[57] ABSTRACT

A device and method for removing ice and snow from roofs whereby a flexible sleeve attached to the lower part of a roof is remotely inflated, thereby shattering the ice in a controlled and safe manner. In the preferred embodiment, a mounting frame is sealingly attached to the roof surface and is configured to removably retain the flexible, inflatable sleeve in position on the roof. A number of retention means are disclosed. However, the preferred means is a zipper assembly, which is easy to operate and retains the overall flexibility of the inflatable sleeve to allow it to be rolled up for easy storage when it is removed from a roof. The lower end of the inflatable sleeve extends beyond the lower edge of the roof surface where it is movably secured to the edge of the roof. An operator realizing the need to remove ice from a roof remotely inflates the sleeve with a low pressure air supply. The expansion of the sleeve attached to the roof shatters the brittle ice. The movable attachment to the lower edge of the roof allows the sleeve to expand and still retains it in a taught manner when the sleeve is not inflated to prevent flapping in windy conditions.

24 Claims, 18 Drawing Sheets

DEVICE AND METHOD FOR REMOVING ICE AND SNOW FROM ROOFS AND OVERHANGS

This is a continuation of application Ser. No. 08/703,642 filed on Aug. 27, 1996.

This application claims the benefit of U.S. Provisional Application(s) No(s).:

60/010,959 filed Feb. 1, 1996, now abandoned

60/016,565 filed May 3, 1996, now abandoned

06/019,745 filed Jun. 10, 1996, now abandoned.

FIELD OF THE INVENTION

The invention relates to a device and method for removing ice and snow from roofs and overhangs.

BACKGROUND OF THE INVENTION

A common problem found throughout the world is the buildup of ice and snow on the roofs of buildings during the winter months of the year. The problem can be seen on all types of buildings, from small cottages to the largest of industrial and commercial complexes. Typically, as the snow sits on a sloped roof, the bottom portion of the roof area will begin to show ice buildup after only a few days. As ice begins to form on the roof, the problem is further compounded by the formation of icicles and other ice formations in the gutter and eve section of many roofs. While the formation of ice may cause damage to a building's gutters, roof, eve and walls, the formation of icicles can lead to a much greater problem-falling ice. The resulting problems of ice and snow buildup on outdoor structures are well known and include; damage to structures, interior and exterior water damage, excessive roof loading, which may eventually lead to roof failure, falling ice, which may injure people located below the ice formation, window damage, gutter damage, etc.

Several devices and techniques have been employed in the past to attempt to overcome these problems. One method is to use an electric heating tape fastened to roofs to melt ice and snow. Not only are heating tapes unsightly, but also draw electric power continuously, even when not needed.

Another method is to climb onto a roof and shatter the ice with a hard, blunt object, like a shovel, hammer, pipe, or ax. This has the disadvantage of being extremely dangerous, since a person must climb onto an icy roof. Also, the action of shattering ice with a hard object may damage the roof.

Another method is to climb onto a roof and chip away at the ice using a sharp object, like an ice chopper or hatchet. This method is even more likely to cause damage to the roof and associated structures.

Similarly, the prior art method for removing icicles is to knock them down from below. This method is extremely dangerous.

The methods of shattering with a blunt object, chipping with a sharp object, and knocking down from below, have the additional disadvantage of having very high labor costs. Companies that provide these services charge high rates, since the work is hazardous and seasonal. The use of a heating tape is also unsatisfactory, since the tapes use electric power continuously during a time of year when electricity use is already high. The tapes must be energized continuously, and do not shut off when ice and snow have been removed. They are also ineffective, since they only heat their immediate area.

SUMMARY OF THE INVENTION

Accordingly, it is an object of the invention to provide a simple device that can be easily installed on common roof designs, which will eliminate the problem of ice buildup.

Another object is to provide an apparatus that is easy to install and remove so that it can be used during the winter season, can be removed easily in the spring and be stored until the next winter.

Another object is to provide a user of the invention with a high level of safety when operating the system to dislodge ice formations and icicles from the roof. The user may use a portable inflation device (blower or pump) to inflate the sleeve from a safe location.

Another object of the invention is to operate the system on a routine basis, preventing large amounts of ice from forming in the first place.

Another object of the invention is to allow the mounting frame assembly to remain in place year round without effecting the function and aesthetics of the roof.

Another object of the invention is to provide a mounting frame that can be removed from the roof along with the inflatable sleeve easily and then be reinstalled for use for the next winter in the event that a user of the device does not desire the mounting frame to be in place on the roof during non-winter months.

Another object of the invention is to provide a modular system that can be made up of many standard lengths and designs that can be mixed and matched (combined) for almost any roof size and roof design. The frame and sleeve components can be combined with each other to create a total system if desired.

Another object of the invention is to provide an apparatus that incorporates replaceable parts in the event that a portion of the apparatus fails.

Another object of the invention is protect gutters and other components of the roof from ice, water and other damage caused from loading. A drip edge will also help direct runoff water away from the exterior wall of the structure and over the gutter system.

Another object of the invention is to secure the system so that wind will not blow it around. It is designed to remain secured to the roof while also being able to expand and move during inflation.

Another object of the invention is to provide the user with an affordable solution to ice and snow build up problems. The materials used for the components will be relatively inexpensive. Reinforced vinyl-coated fabric will be used for the inflatable sleeve and a plastic extrusion can be used for the frame hardware. The air source can be a simple air pump or vacuum/blower.

Another object of the invention is to provide many problem solving features of the overall system. One embodiment would simply be the use of plastic sheeting only. This on its own may cause the ice to slide off. A Teflon type surface may be useful for this purpose. Other designs would help protect gutter assemblies, as well as provide a drip edge away from the side of the structure.

Another object of the invention is to provide a solution with a low energy requirement. It is well known that electrical wiring can be mounted on a roof surface to heat the ice and snow away. This type of melting system requires constant power to have any effectiveness. The power requirement for the disclosed invention is minimal, the compressor or blower may be turned on only until full inflation is reached—usually a minute or less.

Another object of the invention is to provide safe and easy operation of the invention when installed on high roofs and overhangs that would otherwise require work crews and extension ladders and a lift.

Another object of the invention is to allow the operator to operate the system from indoors.

Another object of the invention is to allow the user to operate the invention from a ground level location.

Another object of the invention is to use hot or warm air as part of the mounting frame assembly (via a passage way or tube of some kind) or through the inflatable sleeve device.

Another object of the invention is to use a wire assembly as part of the mounting frame to melt snow and ice in desired locations. A hot wire assembly may also be used on a portion of the inflatable sleeve assembly.

Another object of the invention is to allow the roof system to function as designed without limiting the run-off and snow slide principals.

Another object of the invention is to provide modular components so that virtually any roof configuration can be fitted.

Another object of the invention includes the use of a release agent (Silicone or Teflon) on the invention (inflatable sleeve and/or mounting frame) to help free the invention from snow and ice.

Another object of the invention is to provide protection against the roof surface as well as flashing, side wall and other roof areas of a building.

Another object of the invention is to manufacture the mounting frames with extensions tabs and components so they will overlap and join together eliminating seams that might leak.

Another object of the invention is to provide one universal mounting frame that can be easily installed for use with a wide variety of rigid roof panels designs.

Another object of the invention is to provide a dam or gate effect that is able to hold back and control snow from sliding off roofs.

Another object of the invention is to provide a one-piece system using a flexible mounting tab as part of the inflatable sleeve system.

Another object of the invention is to provide a disposable or limited use system at a low cost.

The foregoing objects are accomplished using a device for removing ice and snow from roofs and overhangs comprising an inflatable sleeve made of a flexible material, an installation mounting frame and method that can be easily interfaced with existing building designs, and a means for inflating the inflatable sleeve. The inflatable sleeve is mounted near the bottom of a roof, in the region where ice tends to form. After ice has formed over the sleeve, an operator can inflate the sleeve remotely using a low pressure air supply. The expansion of the sleeve shatters the ice, after which it falls to the ground in a controlled and safe manner.

The types of sleeve and installation devices can be selected to protect a variety of different roofs and gutters. Installations may be permanent or temporary. An additional gate-type sleeve may also be inflated to prevent snow from falling from a roof, and then deflated to permit the snow to fall.

The inflatable sleeves can be used with many different types of installation or mounting frame configurations for almost any type of roof construction. Mounting frames or other systems for holding the inflatable sleeves in position upon a roof can be provided for metal, fiberglass and other types of roofing systems, including shingled roofs.

DETAILED DESCRIPTION OF THE INVENTION

Figure 1:
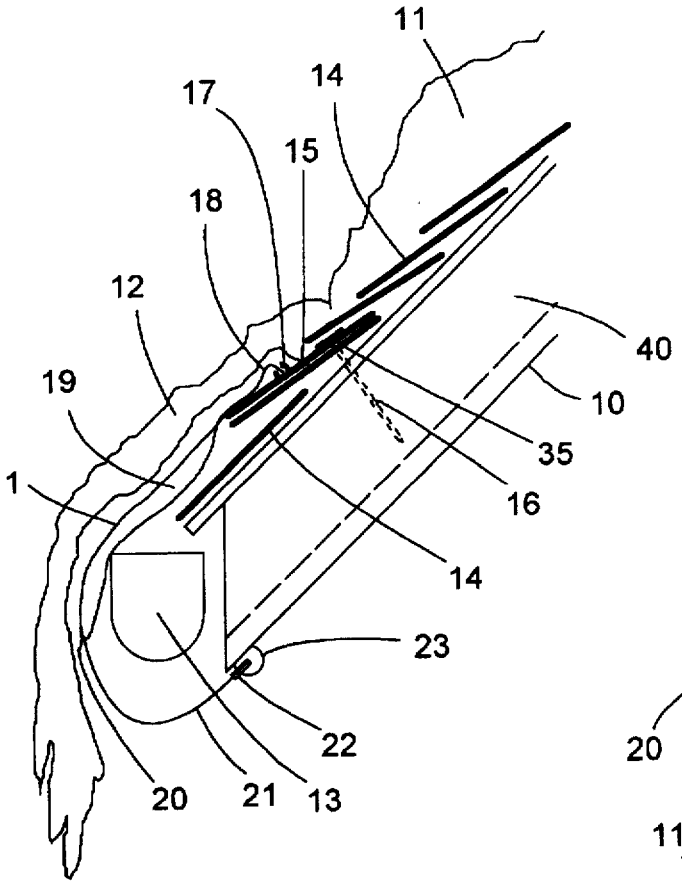
FIG. 1 is the side view of the lower section of a roof for a typical home. The figure shows the installation of a mounting frame assembly to the roof structure with a protective shield having an inflatable sleeve in its proper location along the bottom of the roof. The sleeve is shown in a deflated position, with the formation of ice on it as well as snow on top of the roof.

FIG. 1 shows the invention installed on the lower section of a sloped, shingled roof 14 covered with snow 11 and ice 12. The invention comprises three components: a mounting frame 15, a protective shield 1 having an inflatable sleeve 19; and a blower (not shown) for inflating the inflatable sleeve. The mounting frame 15 is secured to the roof 10 by first lifting up the next higher row of shingles 14 were the frame is to be mounted. A fastener 16 will go through a mounting hole 35 on the mounting frame 15 and into the roof beam 40. The mounting frame 15 has a clamping means 17 to hold a roped edge 18 top section of the protective shield 1 in place on the roof 10. The lower bottom section of the protective shield 1 is held in position on the roof 10 by bungee cords 21, which are secured to the roof 10 by fasteners 22 being secured to mounting clips 23 that are affixed to the house. The inflatable sleeve 19 of said protective shield 1 may be placed over the gutter 13 to provide further protection. A drip edge flap 20 may be placed on the edge of the inflatable sleeve to direct water away from the gutter and house.

Figure 2:
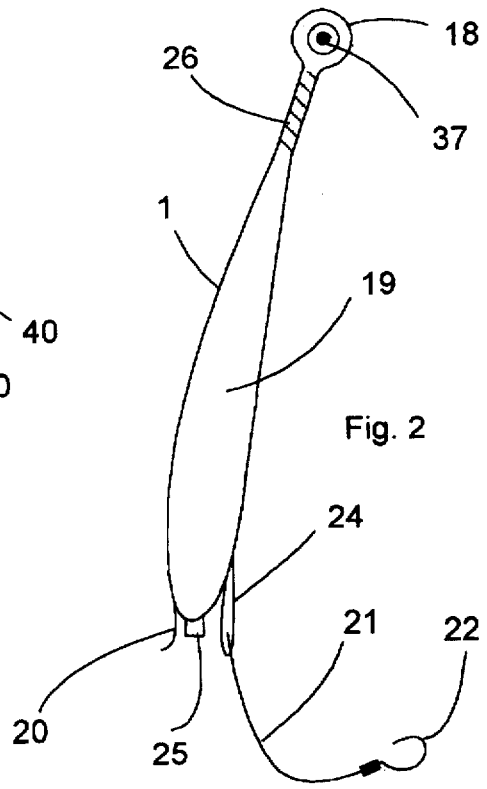
FIG. 2 is a side view of a protective shield design that shows the roped edge assembly at the top. It also shows other elements of the design including a drip edge flap, bungee cord restraint line on the bottom of the sleeve, a fastening means on the bungee and an air inlet fixture for inflating and deflating the sleeve.

FIG. 2 is an end view of the protective shield 1. The top section of the shield has a rope 37 sewn into it forming a roped edge 18. Adjacent to the roped edge 18 is a non-inflatable section 26 of the shield, which is used to isolate the expansion of the inflatable sleeve 19 away from its clamping point so that the expansion and upward movement of the inflatable sleeve 19 will not lift up or loosen the mounting frame from its fixed position. An optional drip edge flap 20 may be located on the bottom edge of the inflatable sleeve 19 to direct any water or runoff away from the side of the structure. An air inlet fixture 25 is located near the bottom of the inflatable sleeve 19 to allow for the inflation and deflation operations. A support flange flap is 24 is secured to the bottom section of the inflatable sleeve 19 to provide an anchoring point from which to fix cord 21. A fastening means 22 is at the other end of the cord 21 is used to secure the bottom of inflatable sleeve 19 to the structure. The cord 21 may be elastic (bungee cord ) or non-elastic. The cord's 21 purpose is to provide a means for holding the inflatable sleeve 19 in position, even during windy and stormy conditions, while still allowing the inflatable sleeve to inflate during the operation of the device. There may be many variations of anchoring the top and bottom sections of the protective shield to the roof, which will be discussed in further detail below.

Figure 3:
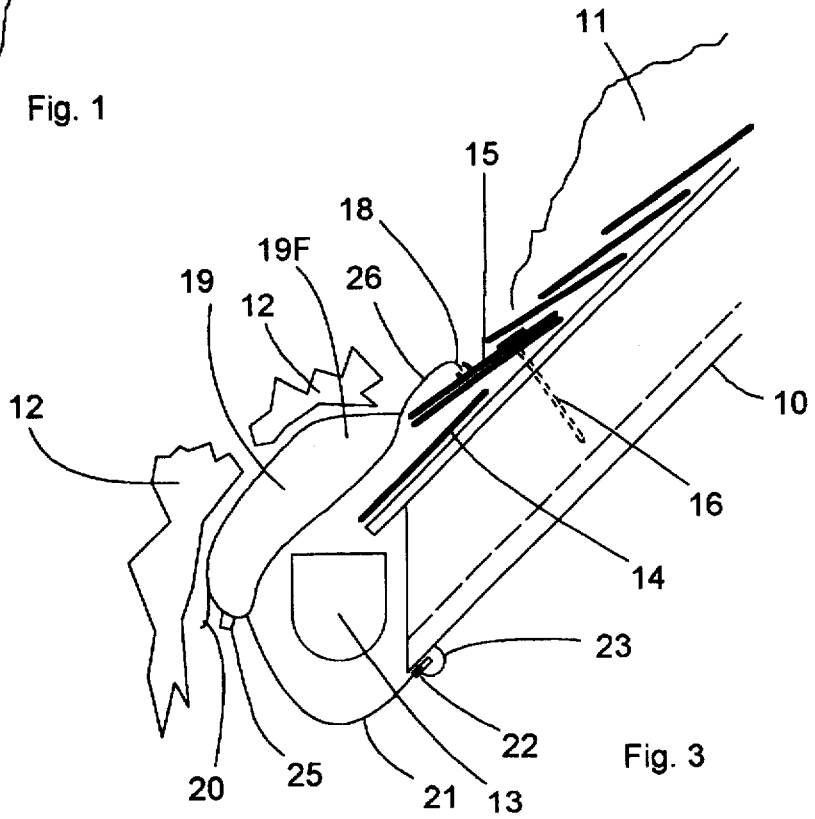
FIG. 3 is a side view of a roof section, illustrating the inflation of the inflatable sleeve. As the sleeve is inflated, causing it to expand, the ice breaks away and falls.

FIG. 3 shows the inflation of the inflatable sleeve 19. As pressurized air is introduced into the inflatable sleeve 19, its expanding action breaks the ice formations 12 that formed on top of the sleeve. A slick coating, such as silicone spray, (WD-40 or Armor-All) may be used as a release agent to remove any excess ice and snow that may build up on inflatable sleeve 19 after installation. Again, notice that non-inflatable section 26 is positioned between roped edge 18 and inflatable section 19F of inflatable sleeve 19. In practice, this boundary or non-inflatable zone 26 may isolate the upward force of the inflation action from the mounting frame. The only force on mounting frame should be laterally, on the same plane with the mounting frame (at the roof slope angle and downward). If the inflatable section is too close to the mounting frame, it may lift and loosen the mounting frame, which could result in problems.

Figure 4:
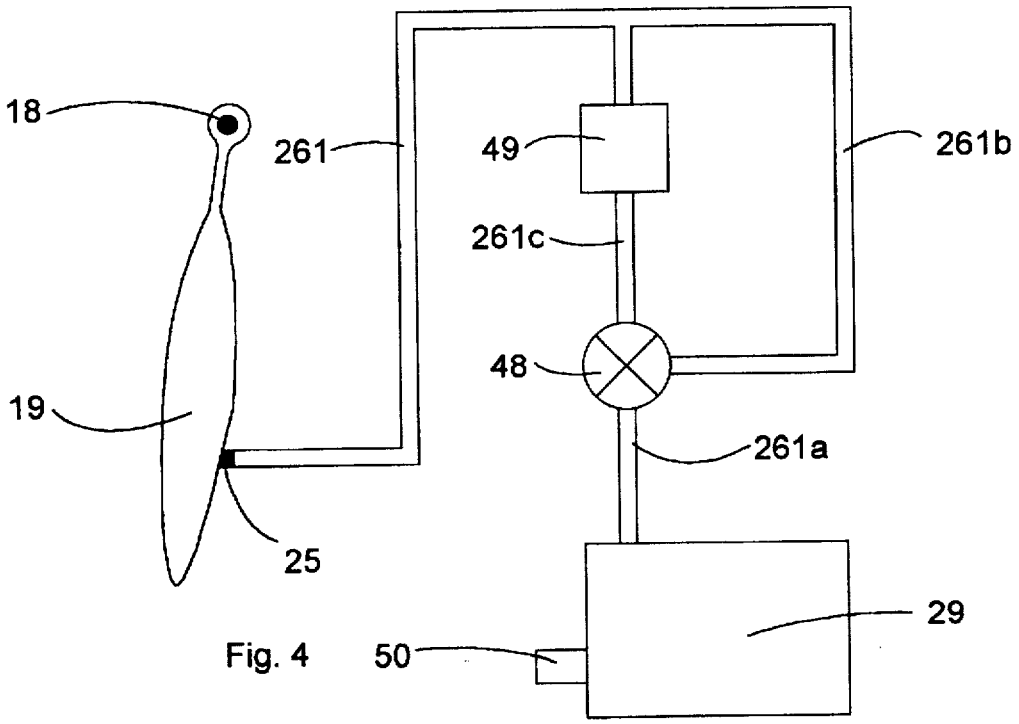
FIG. 4 shows an air source, which can be used to inflate the inflatable sleeve.

FIG. 4 shows one configuration of how the air source 29 can be used to operate the inflatable sleeve 19. Generally, the inflatable sleeve 19 may only be able to withstand a maximum pressure of between 5 and 10 PSI before rupturing under a "no load" condition. It may be necessary however, that a higher pressure may be required to start the inflation and resulting expansion of the inflatable sleeve 19 under a "full load" condition. A "full load" condition can best be illustrated when the inflatable sleeve is actually locked or encased in ice. It needs extra pressure to begin inflating and expanding. Once the inflation and expansion process begins, the pressure requirements for continued inflation and expansion may decrease considerably and stabilize substantially between ¼ to 5 PSI. To accomplish this feature and to ensure that the inflatable sleeve is not operated under "no load" conditions beyond safe pressure levels, valve 48 can be manually switched to bypass the flow of pressurized air around the pressure regulator 49. Once the inflation action begins and the "full load" condition has subsided, the operator can change position of valve 48 to direct air pressure through the pressure regulator. The valve may be a hand operated valve or a solenoid type valve that is controlled by a switch, button, or the like. Air hoses **261*a*, 261*b* and 261*c* create the bypass function allowing the pressurized air to inflate inflatable sleeve 19 through air hose 261 and inflatable sleeve air fixture 25. Under normal operating procedures, the air would travel back through the same hose and valve system for deflation. A one-way (in) check valve would normally not be required. Intake/exhaust port 50 can be mounted on air source 29. A dryer may be required to eliminate moisture from going into the inflatable sleeve 19**.

The inflatable sleeve 19 may be able to withstand high pressures (up to 15 PSI or more) during the initial inflation process. The pressure and expansion force is directed against the load (ice) and not necessarily against the contraction integrity of the inflatable sleeve 19. Also, the interior volume of the inflatable sleeve must be fully inflated before any over pressurization damage may occur. There is an important difference between operating pressures for "no load" conditions vs. "full load" conditions.

Figure 5:
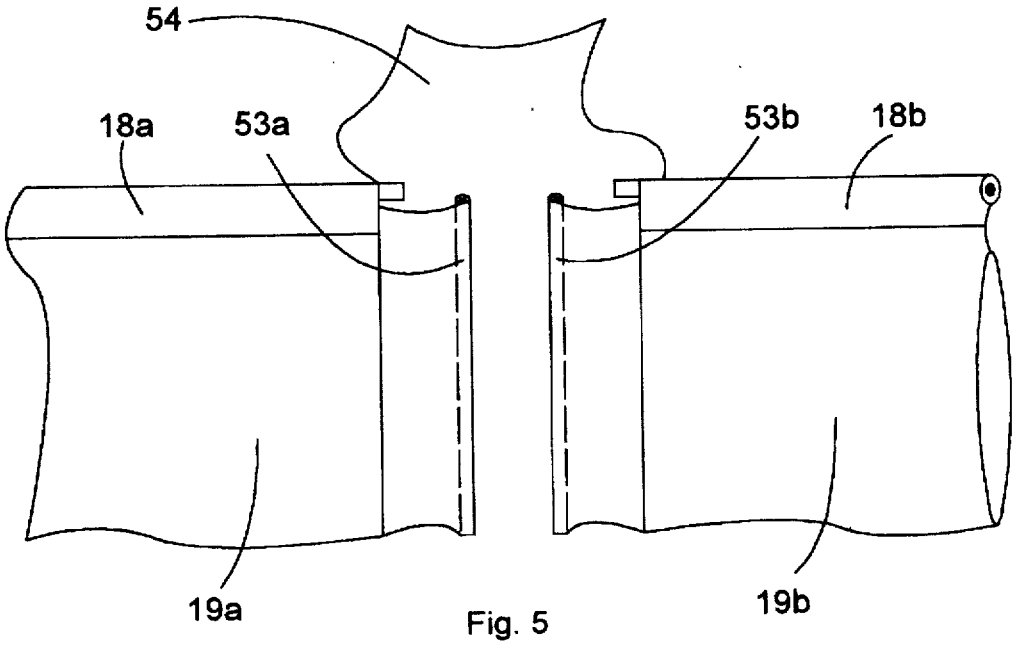
FIG. 5 shows two inflatable sleeves with two roped edges, and a flap to protect the joint.

FIG. 5 shows a top view of the two inflatable sleeves 19*a* and 19*b*. Roped edges 18*a* and 18*b* remain as the primary holding area for installation into mounting frame. Roped edges 53*a* and 53*b* are normally located at the vertical ends of the inflatable sleeves (any sleeve) and are perpendicular to roped edges 18*a* and 18*b*. The roped edge design provides an easy method of installation for both the Do-It-Yourselfer as well as the Professional. The roped edge design also provides a strong end seam and simple closure method for sealing end sections of the inflatable sleeve and modular component system. Flap 54 may act as a cover over the joint created by holding means 52 so that water, snow and ice does not get under the mounting frame and inflatable sleeve system. Flap 54 may be fastened to inflatable sleeve 19*a* and 19*b* by "VELCRO" hook and loop fasteners, ties, snaps, removable caulk, adhesive, etc. Of course, alternative embodiments of the invention use other fastening means in place of the roped edge-holding assembly. Other fastening means include zippers or other like means for joining adjacent inflatable sleeves.

Figure 6:
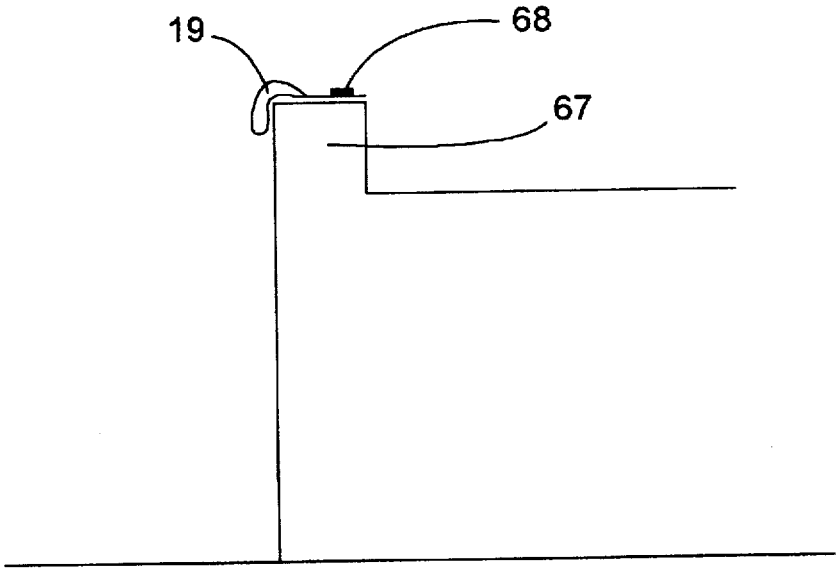
FIG. 6 is a side view of the inflatable sleeve installed on the top structure of a substantially flat roof.

FIG. 6 is a side view of a the top structure 67 of a building that has a generally flat or gently sloped roof line. Clamp assembly 68 may be used install inflatable sleeve 19 on the top surface of building structure 67.

Figure 7:
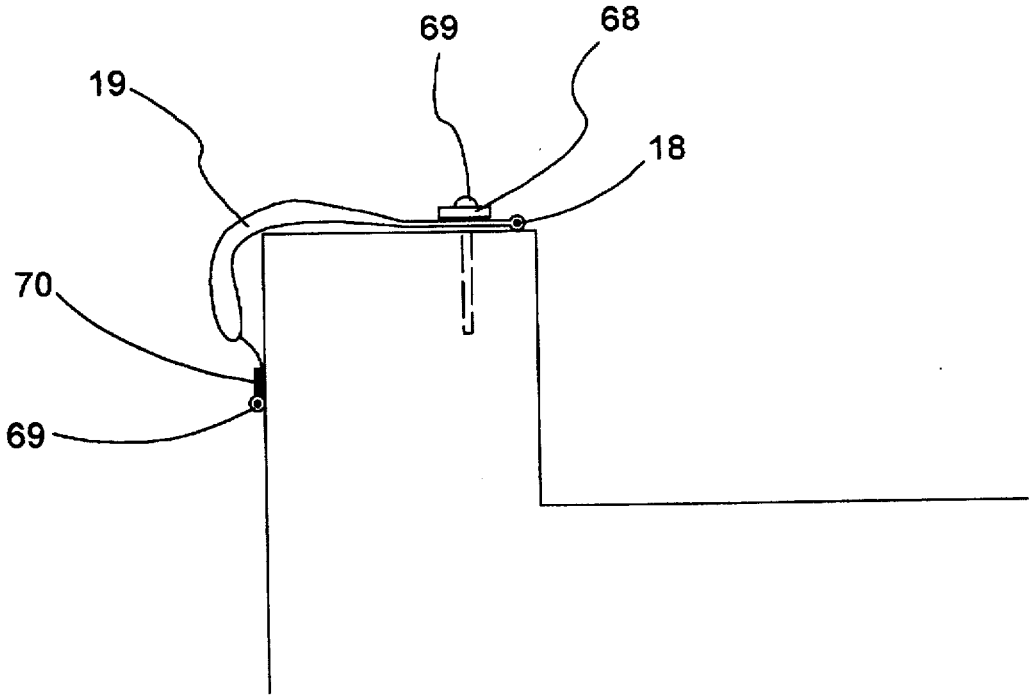
FIG. 7 is a detailed view of the fastener and clamping assembly of the inflatable sleeve on a flat roof surface.

FIG. 7 is an enlarged view showing fastener 69 holding inflatable sleeve 19 and clamping assembly 68 in place. Roped edge 18 cannot pull through clamping assembly 68. While the inflatable sleeve design will generally assume the same size and shape dimensions, the mounting frame or mounting assembly can be adapted to fit almost any kind of mounting surface. Clamping assembly 70 may also be used to secure the bottom end of inflatable sleeve 19. Flap 69 with roped edge is secured by clamp 70 to the side of building.

Figure 8:
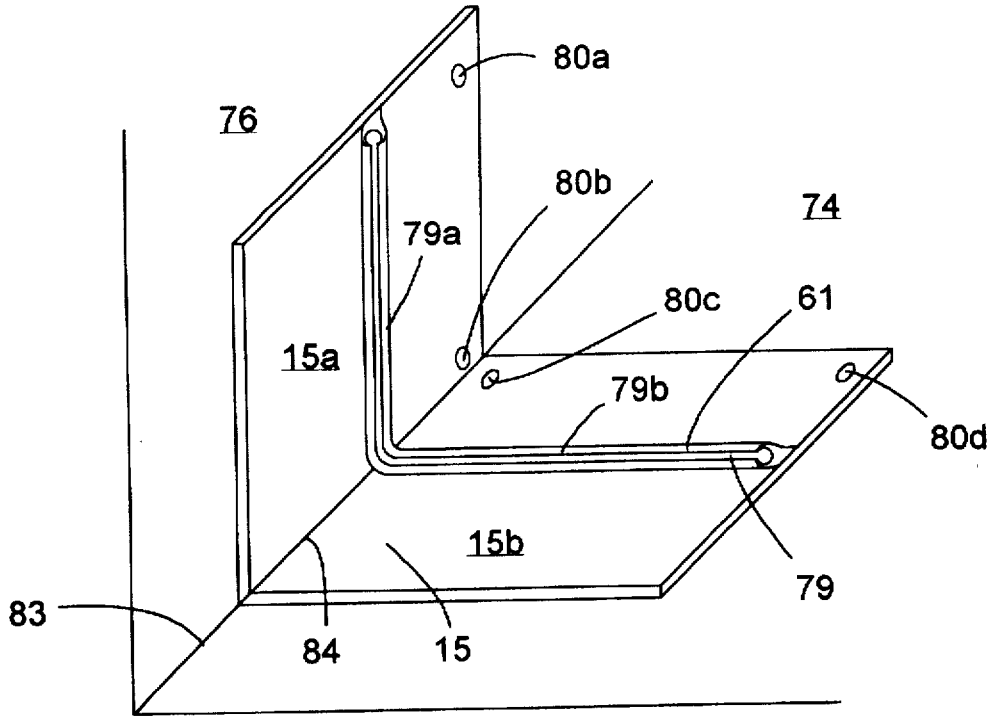
FIG. 8 is an elevated view of a corner roof section and mounting frame.

FIG. 8 is a bird's-eye view of a corner roof section of a building. The mounting frame 15 may be a single, preformed component or can be made of one or more sections. A standard length of extruded mounting frame 15 may be formed on site if desired. The right side of mounting frame 15*b* is fastened to roof section 74 while the left side of mounting plate 15*a* is fastened to vertical wall 76 of the roof. Corner joint 84 of mounting frame 15 fits securely in wall/roof joint 83 so that a watertight fit is made. Caulk or other sealant may be applied around the mounting frame. Clamping fixture 61 runs from end to end on the right angle mounting frame, on the vertical clamping fixture 79*a* and horizontal clamping fixture 79*b*.

Mounting holes 80*a* and 80*b* hold the mounting frame section 15*a* tightly secured to wall 76 while mounting holes 80*c* and 80*d* hold down mounting frame section 15*b*. This right angle mounting frame section 15 can be designed to interface easily with other modular or custom made mounting frame sections if desired. Roped edge of inflatable sleeve (not shown) will fit securely in slot 79 of clamping fixture 61.

Figure 9:
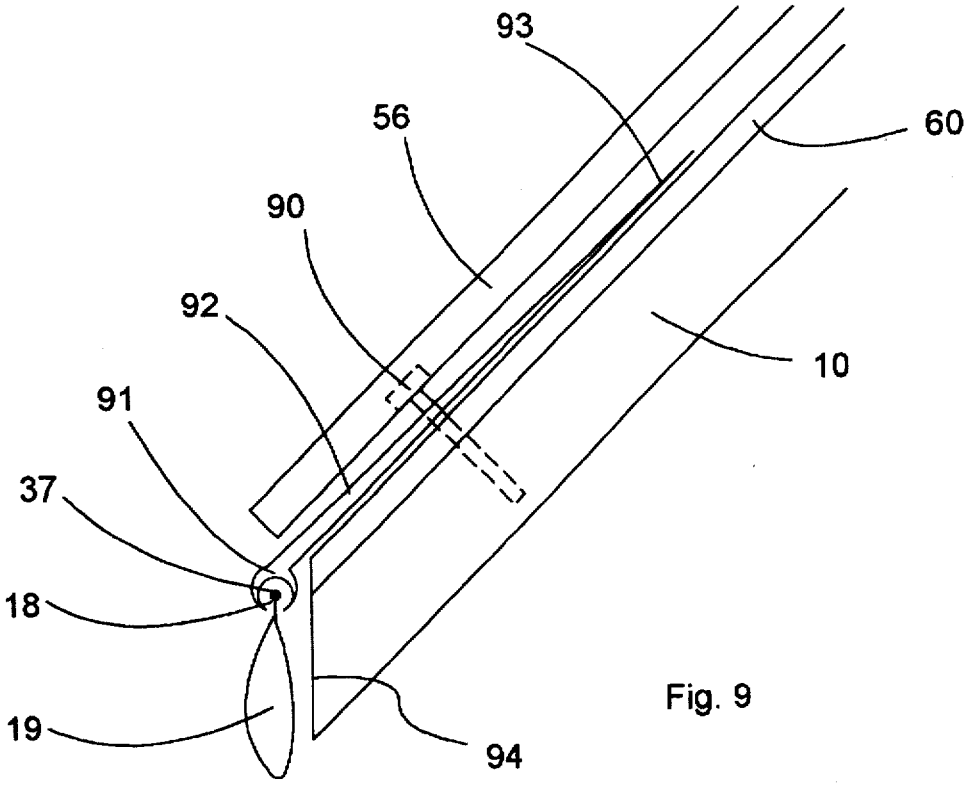
FIG. 9 is a side view showing the mounting frame sandwiched between the roof panels and the underlayment decking of the roof.

FIG. 9 shows mounting insert 92 with the top end 93 slightly tapered and clamping end 91 at the bottom of the roof line, sandwiched between rigid roof panels 56 and roof decking 60. Screws 90 hold the roof panels 56 and mounting insert 92 in place on the roof decking 60. Inflatable sleeve 19 utilizes rope 37 to form roped edge 18 to fit inside clamping end 91 of mounting insert 92. As inflatable sleeve 19 is inflated, any ice formations or icicles will be broken away from the eve section of the roof 10. To avoid any blockage for snow that may slide off roof panels 56, it may be desirable to fabricate mounting insert 92 so that clamp end 91 is below the lower elevation plane of roof panel 56. In actual use, face plate 94 will provide a backstop for inflatable sleeve 19 to inflate against.

Figure 10:
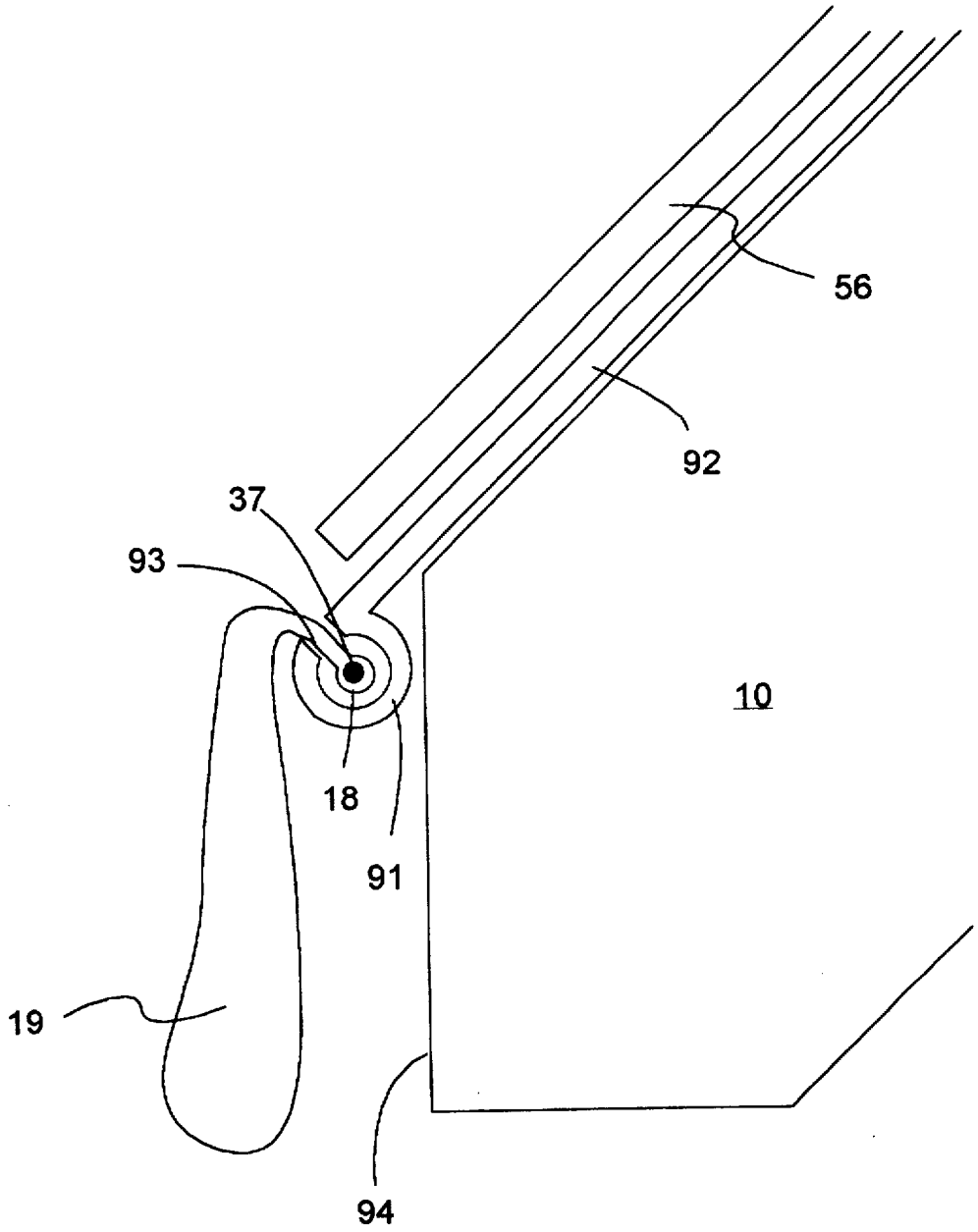
FIG. 10 is a side view of the bottom section of a roof with the mounting insert in place under the roof panels. The clamping end slot opening is angled upwards to create a different inflating direction.

FIG. 10 shows the mounting insert 92 secured between roof panel 56 and roof 10. Clamping end 91 of mounting insert 92 has slot opening 93 facing up to create a different inflation pattern for inflatable sleeve 19. Roped edge 18 of inflatable sleeve 19 is secured through slot opening 93 that is narrower than rope 37 inside roped edge 18 of inflatable sleeve 19. Inflatable sleeve 19 is shown in the deflated position.

Figure 11:
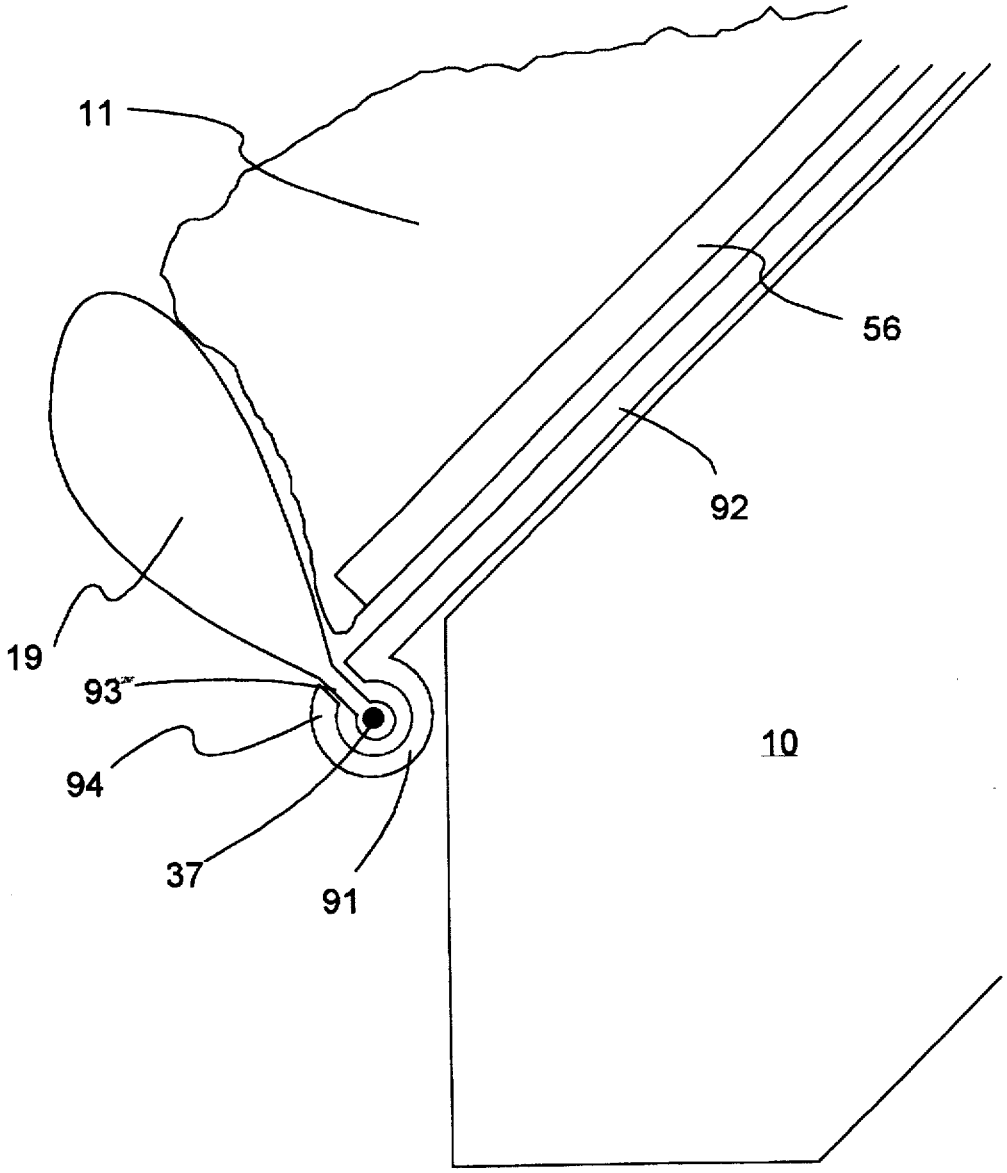
FIG. 11 is a side view of the bottom section of a roof with the inflatable sleeve inflated in the clamping end that is slotted upwards.

FIG. 11 shows the inflatable sleeve 19 in the inflated position. Because the slot opening 93 is facing up and bottom end 94 of clamp end 91 of mounting insert 92 is beyond slot opening 93, the inflatable sleeve 19 will tend to inflate upwards as shown. This configuration will cause the inflatable sleeve to act as a dam or gate to hold snow 11 from sliding off roof panels 56. In addition to breaking off ice that may hang vertically from the end of roof panels 56 and clamping end 91 of mounting insert 92, this configuration may provide safety from snow sides. A user may deflate inflatable sleeve 19 to allow snow to slide off roof panels 56 at controlled or designated times, rather than at random, which could cause potential dangerous situations. User can inflate inflatable sleeve 19 and leave inflated for various time.

Figure 12:
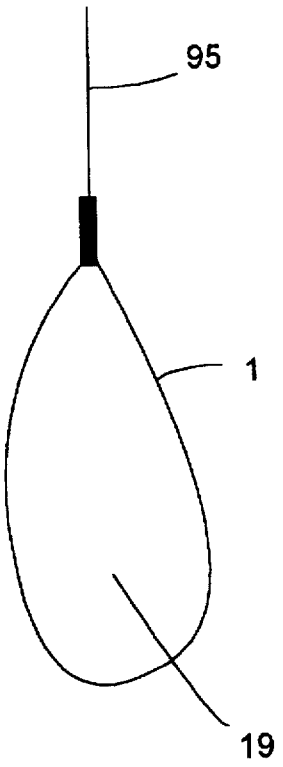
FIG. 12 is an end view of the inflatable sleeve showing the installation flap.

FIG. 12 shows an end view of a protective shield 1 having inflatable sleeve 19 with mounting flap 95. Mounting flap 95 may be made of more than one ply of fabric to provide greater strength.

Figure 13:
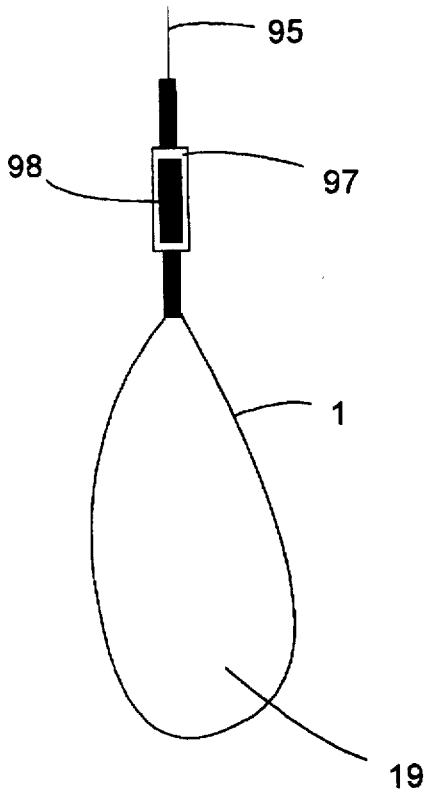
FIG. 13 is an end view of the inflatable sleeve with a stiffener type batten held within a pocket compartment.

FIG. 13 shows an end view of protective shield 1 having inflatable sleeve 19 with a compartment 97 fabricated as part of mounting flap 95 so that a batten type stiffener 98 may be inserted to provide a more even support along the length to the inflatable sleeve component. Without the batten stiffener, the inflatable sleeve could sag between fastening points. The batten 98 will act like a curtain rod or closet hanger pole to prevent sagging between anchor points of flap 95.

Figure 14:
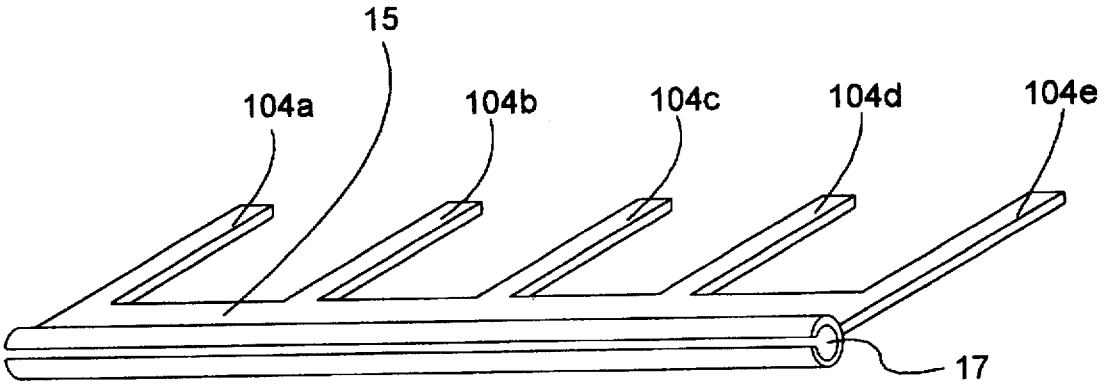
FIG. 14 is a side angle view of a mounting frame with reduced surface area to increase heat transfer from the roof to the shingles.

FIG. 14 is another version of mounting frame 15 with a reduced surface area to allow the transfer of heat from the roof to the shingles and snow above. Installation tabs 104*a*, 104*b*, 104*c*, 104*d* and 104*e* are provided as part of mounting frame 15 for fastening the unit to the roof. Bottom clamp fixture 17 of mounting frame will need to provide strength and stability of frame for securing the inflatable sleeve component of the invention.

Figure 15:
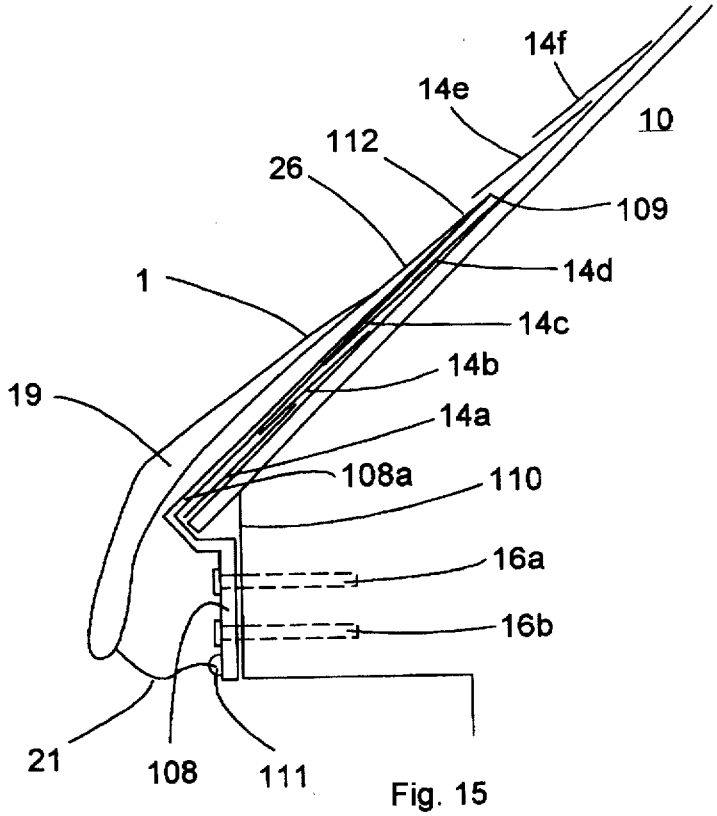
FIG. 15 shows a mounting frame fastened to the face of a roof structure.

FIG. 15 is a side view of a roof section showing a modified mounting frame 108 fastened to face 110 of roof structure 10. Modified mounting frame 108 can be designed so that it is adjustable to fit a variety of roof types and slopes. The top section 108*a* of mounting frame 108 will extend upwards along the roof surface (shingles 14*a* to 14*f*) so that protective shield 1 can be secured to mounting frame extension 108*a* at fastening location 109. Non-inflatable section 26 of inflatable sleeve 19 can be used for the fastening area 109. Upper flap 112 of inflatable sleeve 19 will extend upwards and under shingle 14*e* to form a watertight surface. This mounting frame 108 design eliminates the need to fasten anything to the roof surface whether it is covered with shingles (14*a* to 14*f*) or metal or fiberglass panels, etc. Holding fixture 111 may be added to mounting frame 108 to secure cord 21 from inflatable sleeve 19 so that it remains in position and does not flap around causing noise and damage during windy conditions.

Figure 16:
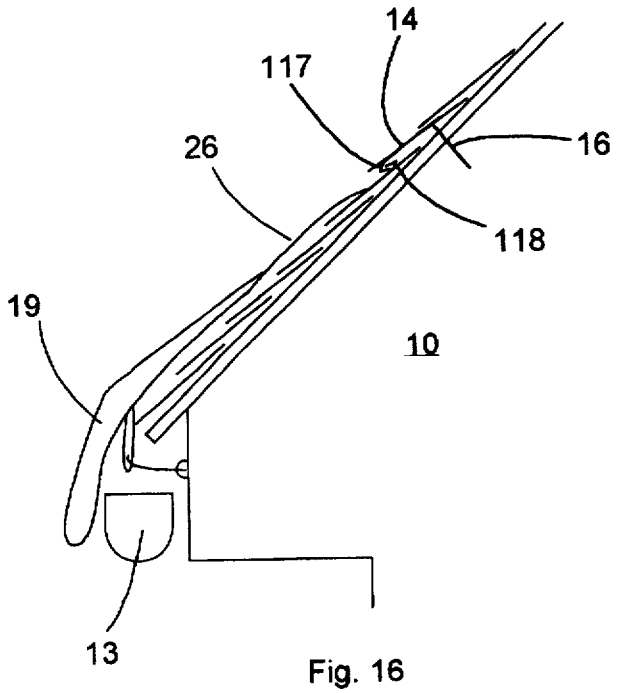
FIG. 16 is an end view of a roof showing a different version of a mounting frame and bracket that is hidden under a row of shingles.

FIG. 16 is an end view of a roof section showing a mounting frame 117 and a mounting bracket 118 hidden under the row of shingles 14. When the inflatable sleeve 19 is removed for part of the year, the mounting frame 117 is not noticeable and will not detract from the normal aesthetics of the roof 10.

Figure 17:
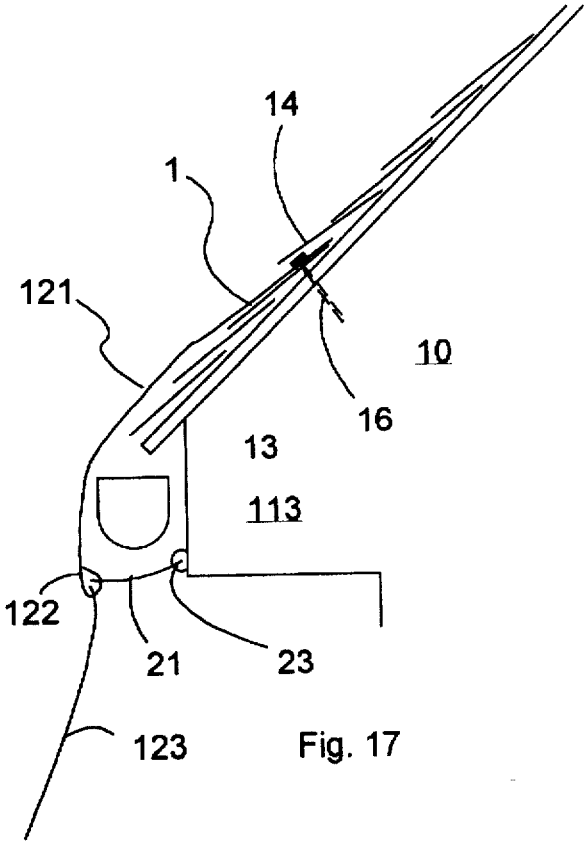
FIG. 17 shows an embodiment of the invention that uses a slick cover in place of an inflatable sleeve.

FIG. 17 is an end view of a roof section showing a simple embodiment of the invention. This embodiment comprises the use of a protective shield 1 comprising a simple cover 121, which protects the roof in the area where ice typically forms. Top end of the cover 121 is fastened to the roof 10 under the shingle 14. A bottom end 122 of the cover 122 is fastened to the eave 113 by attaching shock cord 21 to the anchor 23. The cover 121 may be made of a rigid material like plastic sheeting or of a flexible material like coated fabric. The gutter 13 is thus protected from ice damage. As compared with a shingle roof that is uncovered and holds ice like it was glued on, a smooth cover surface over the shingles allows one to remove ice formations much easier. The cover 121 acts as a release surface so that the ice may be removed from the roof 10 much easier and with less damage. Any of the mounting frames, mounting brackets and other installation methods may be used with this non-inflatable configuration of the invention. In addition to simply providing a smooth surface so that ice may easily slide off of a roof, this embodiment could incorporate a mechanical agitation means, which would in essence "shake" any ice formed on top of cover 121 off of the roof. The mechanical agitation means may comprise pull cords, ropes or other lines 123, which extend down towards the ground where a person could tug upon them to agitate the cover's surface. Alternatively, a person could use a long pole or rod (not shown) to physically disturb the cover where it passes over the edge of the roof.

Figure 18:
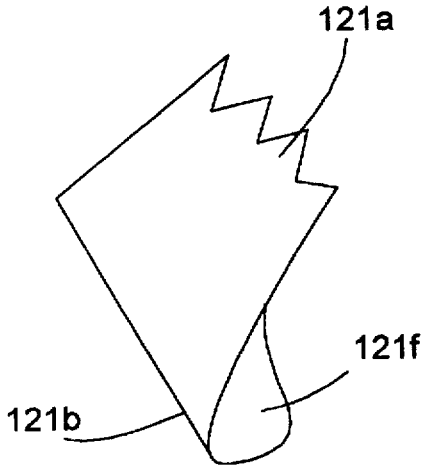
FIG. 18 is a close up view of the bottom of an extra exterior flap attached to the flexible sleeve cover of FIG. 17.

FIG. 18 is a close up of lower end 121*b* of extra exterior flap 121*a*. The lower end of the flap includes a pocket 121*f*, which is configured to hold a weighting medium and thus prevent flap 121*a* from flapping uncontrollably in windy conditions.

Figure 19:
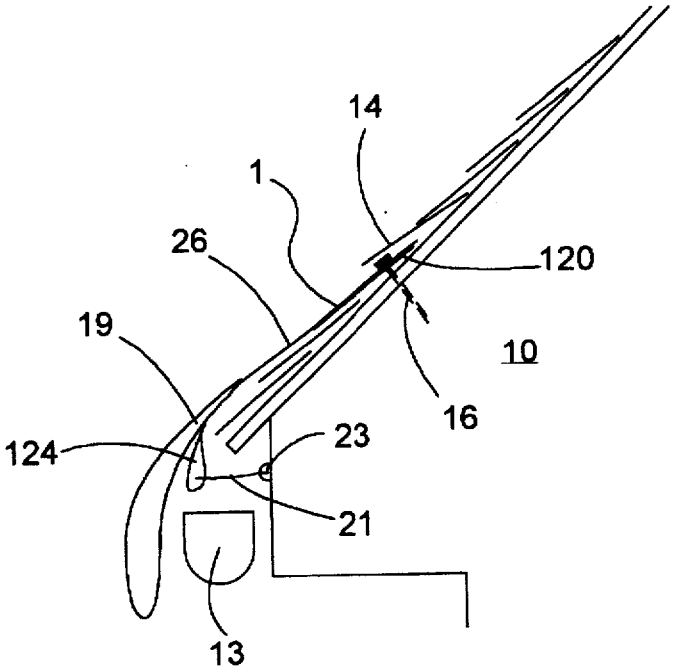
FIG. 19 is a version of the invention that uses an inflatable sleeve and fastener, but does not use a mounting bracket or mounting frame.

FIG. 19 is a side view of a roof section showing a top end of the inflatable sleeve 120 without any rigid reinforcement or mounting bracket attached. The fastener 16 is simply screwed, nailed or stapled through the top end 120 of the inflatable sleeve 19 and to the roof 10 under the shingle 14.

Figure 20:
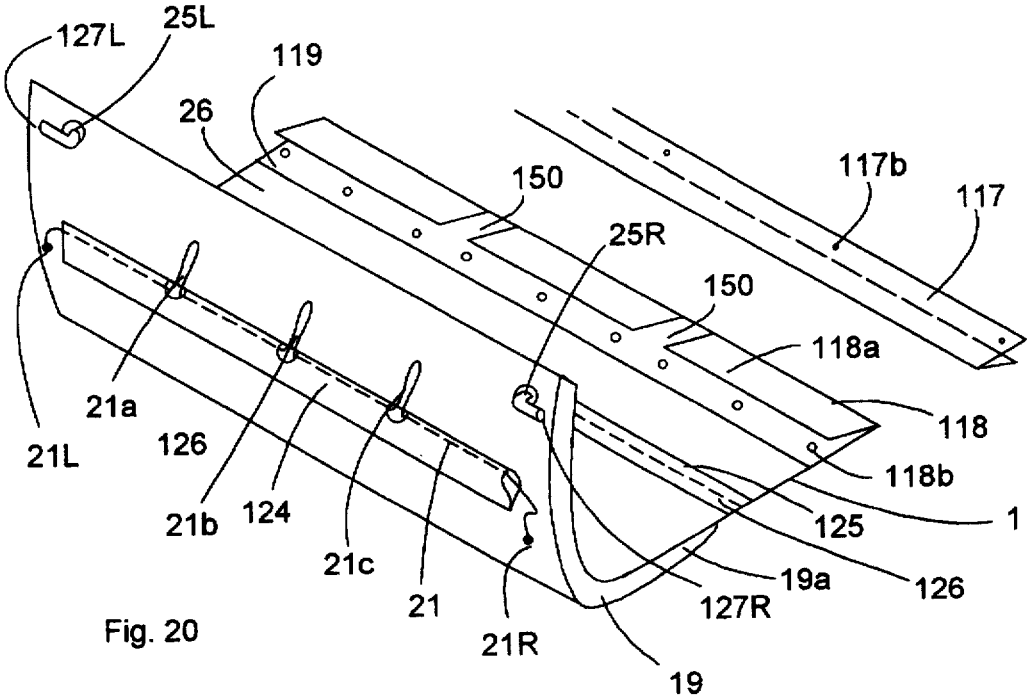
FIG. 20 shows the construction and design details of a section of the apparatus.

FIG. 20 is a bird's eye view of the protective shield 1 that shows many of the individual design components in their preferred embodiments. On the underside of the bottom of the inflatable sleeve 19, air inlet fixtures 25R and 25L are shown as 90 degree elbows. External openings 127L and 127R of the air inlet fixtures 25L and 25R, respectively, are on the same plane as the length of the inflatable sleeve.

This design will ensure that the inflatable sleeve 19 does not wrinkle or buckle when the connecting air hoses are attached. In general, the air inlet fixtures 25R and 25L are located 6 inches (15 cm) from each end to allow for overlapping of the inflatable sleeve 19 modular components when they are connected into one system.

A bungee cord 21 may be attached to the ends of the inflatable sleeve at points 21L and 21R. The bungee cord 21 is held inside a loop assembly 124. Openings are provided in the loop assembly 124 at certain intervals so that the bungee cord 21*a*, 21*b* and 21*c* can be extended and attached to guide-anchors. (See FIG. 60 that show the guide-anchors 21*a*, 21*b*, 21*c*.) The preferred average distance interval 128 between bungee attachments 21*a*, 21*b* and 21*c* is substantially 18 inches (46 cm).

An air tight compartment 19*a* of the inflatable sleeve 19 is made by sewing an end to the main section at stitch location 125. A sealant 126 may be applied after the stitching procedure to ensure that a water tight seal is maintained. While air leakage through the stitch area is not an insurmountable problem, water that may leak through the stitch may fill the air inlet fixtures 25 and block the flow of air during inflation. The non-inflatable section 26 is shown between the top mounting bracket 118 and the inflatable sleeve compartment 19*a* of the inflatable sleeve 19.

The top mounting bracket 118 is attached to the top side of the inflatable sleeve 19 at location 119. Gaps 150 are provided between the mounting brackets 118 so that the sleeve assembly can be folded for easier handling when not installed. Rivets 118*b* and glue (not shown) are used to hold the mounting bracket 118 to the inflatable sleeve 19. The mounting frame 117 is shown with holes 117*b* for mounting. An edge tab 118*a* of the mounting bracket 118 is placed in a slot 117*a* of the mounting frame 117 for attachment.

Figure 21:
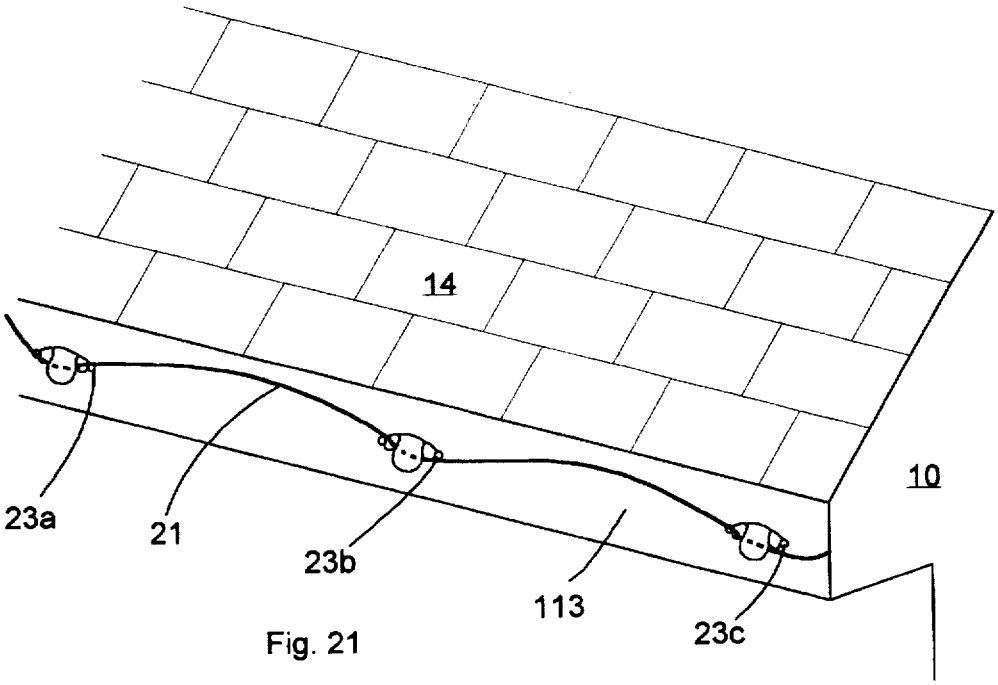
FIG. 21 shows the placement and position of guide-anchors used to restrict the movement of the inflatable sleeve.

FIG. 21 is a bird's eye view of the roof section 10 with shingles 14 and eave section 113. Guide-anchors 23*a*, 23*b* and 23*c* are shown permanently fastened to the eave 113 of the roof 10. Guide-anchors 23 are designed to hold the shock cord 21 in place while also providing the installer a design for easy attachment and removal.

Figure 22:
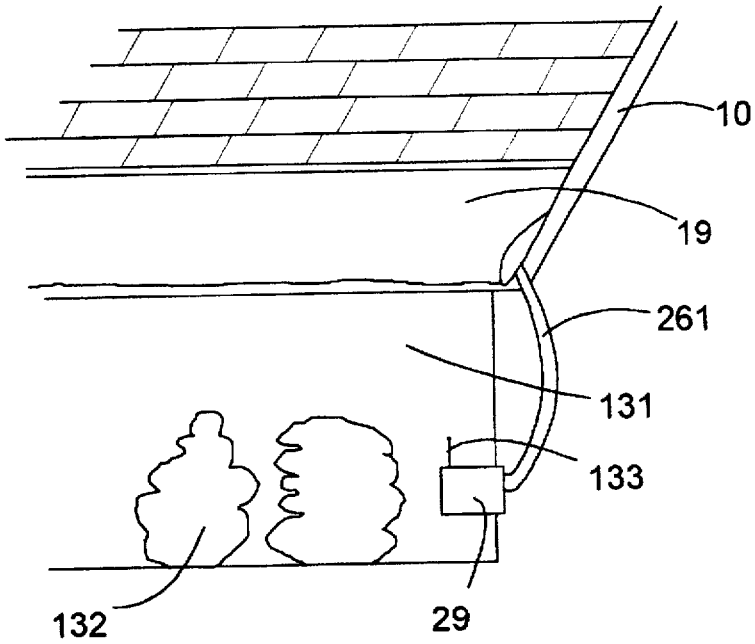
FIG. 22 shows a version of the inflation and control means for the inflatable sleeve.

FIG. 22 is a front view of a building 131, obstructed by objects 132 like bushes and shrubs. A control box 29 provides air to the inflatable sleeve 19 through an air hose 261. An antenna 133 on the control box 29 allows the operator to inflate the sleeve 19 by remote control. Remote control operation permits the operator to remove ice and snow from a clear and safe area. Alternatively, a timer may be utilized to activate the air source so that ice removal could be accomplished on a scheduled basis.

Figure 23:
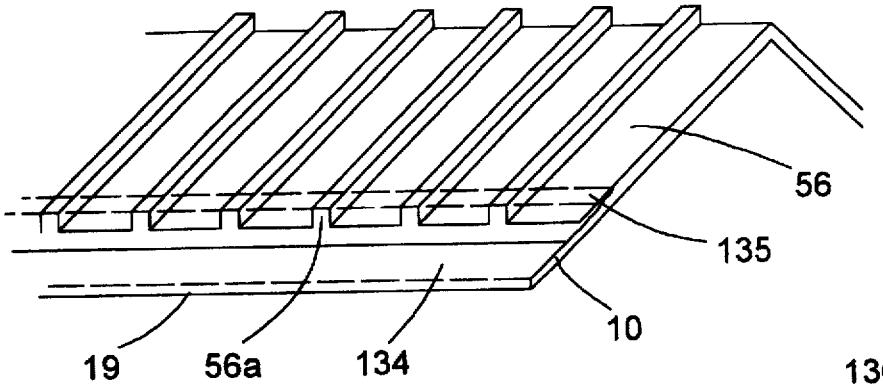
FIG. 23 shows a version of the invention adapted for use with a panel type roof.

FIG. 23 is a bird's eye view of a panel type roof 56. The lower section of the panel roof 56 (approximately 30 inches or 76 cm) is removed or not installed, as the case may be, and a panel 134 is installed in its place under the bottom end of the roof panel 56. A top end of a mounting frame 135 is installed on top of the panel 134, also under the roof panel 56 as shown. Holes 56*a* may be plugged with foam or other material to prevent access by birds, dirt and other debris to the underside of the paneled roof 56.

Figure 24:
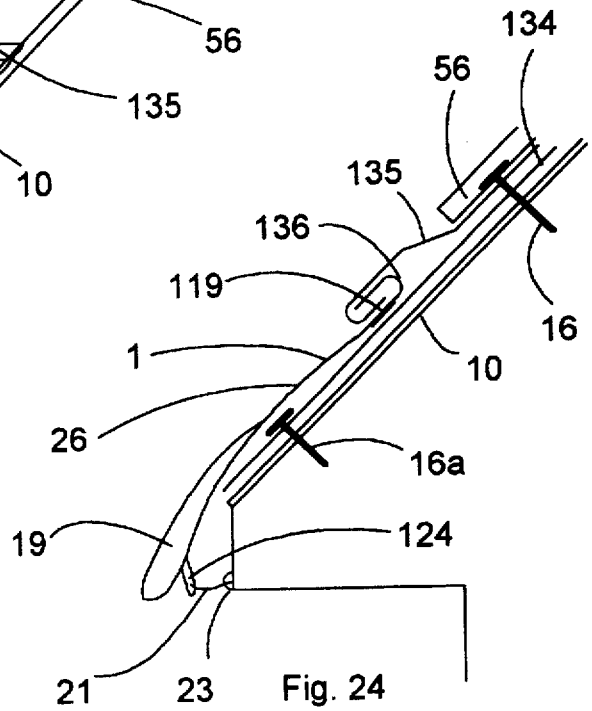
FIG. 24 is an end view showing details of the invention used with a panel type roof.

FIG. 24 is a close up end view of a section of panel type roof 56. Panel 134 acts as the roof surface if the protective shield 1 is removed for the non-winter months of the year. The mounting frame 135 sits on top of the panel 134 and both are held in place by a fastener 16. The bottom end of the panel 134 is held in place on the roof 10 by a fastener 16*a*. The mounting bracket 135, attached to the inflatable sleeve 19 at position 119, is inserted into the "U" shaped end of the mounting frame 135.

The bottom of the inflatable sleeve 19 is attached to the roof 10 by extending a shock or "bungee" cord 21 from a loop assembly 124 to a guide-anchor 23. The use of the bungee cord 21 holds the inflatable sleeve tightly to the roof 10 during high wind conditions while allowing the inflatable sleeve 19 to expand and move away from the roof 10 during the inflation. After inflation, the bungee cord 21 pulls the sleeve 19 back in place and holds it there until the next inflation. While a rigid frame system could be used on the bottom of the inflatable sleeve 19, the bungee cord 21 is the preferred embodiment for this feature of the invention.

Figure 25:
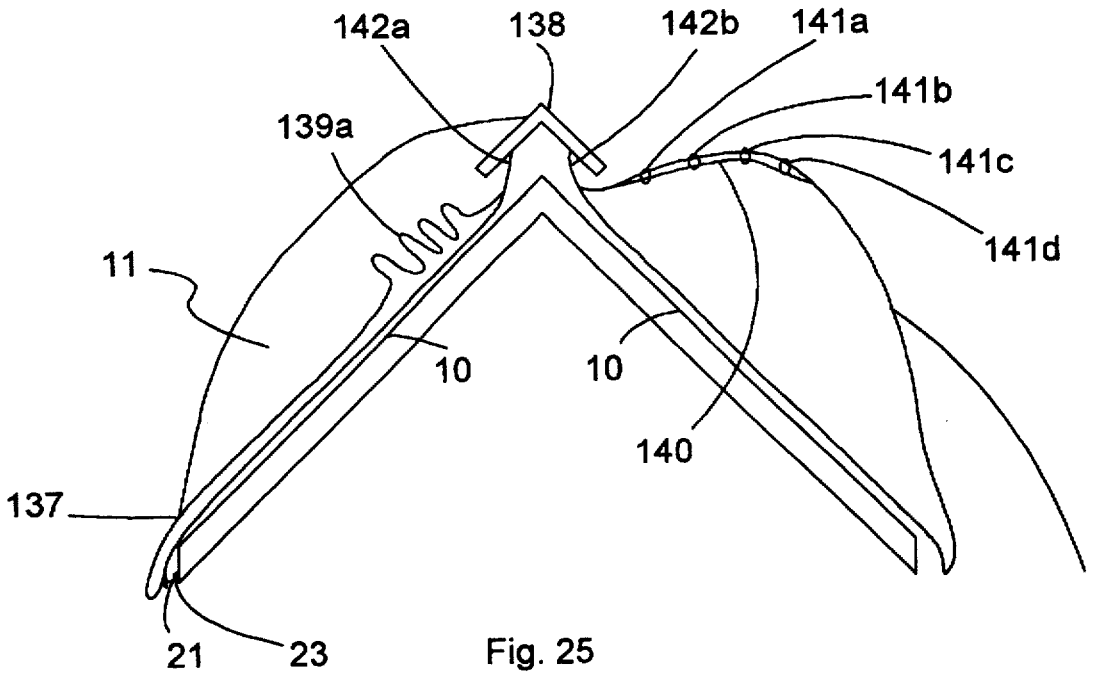
FIG. 25 shows a version of the invention adapted to remove snow as well as ice from an entire roof.

FIG. 25 is an end view of a building with sloped roof. This embodiment of the invention is adapted to remove snow as well as ice from a roof or overhang. An inflatable membrane 137 uses a very similar bungee cord 21 and guide-anchor 23 as the ice design. Because the inflatable membrane 137 must push the snow 11 off of the roof, extra fabric 139*a* is provided at the top end of the system as shown on the left side of the roof.

In operation the extra fabric 139*a* should expand by first forming a steepening angle that will cause the snow to roll off the roof in a manner similar to a crashing wave. A bungee cord 140 will hold a top section of the membrane 139*a* gathered at the top by gathering holding rings 141*a*, 141*b*, 141*c* and 141*d* together. A mounting Plate 138 will hold the top sections 142*a* and 142*b* of the inflatable membrane 137 on the roof 10.

Figure 26:
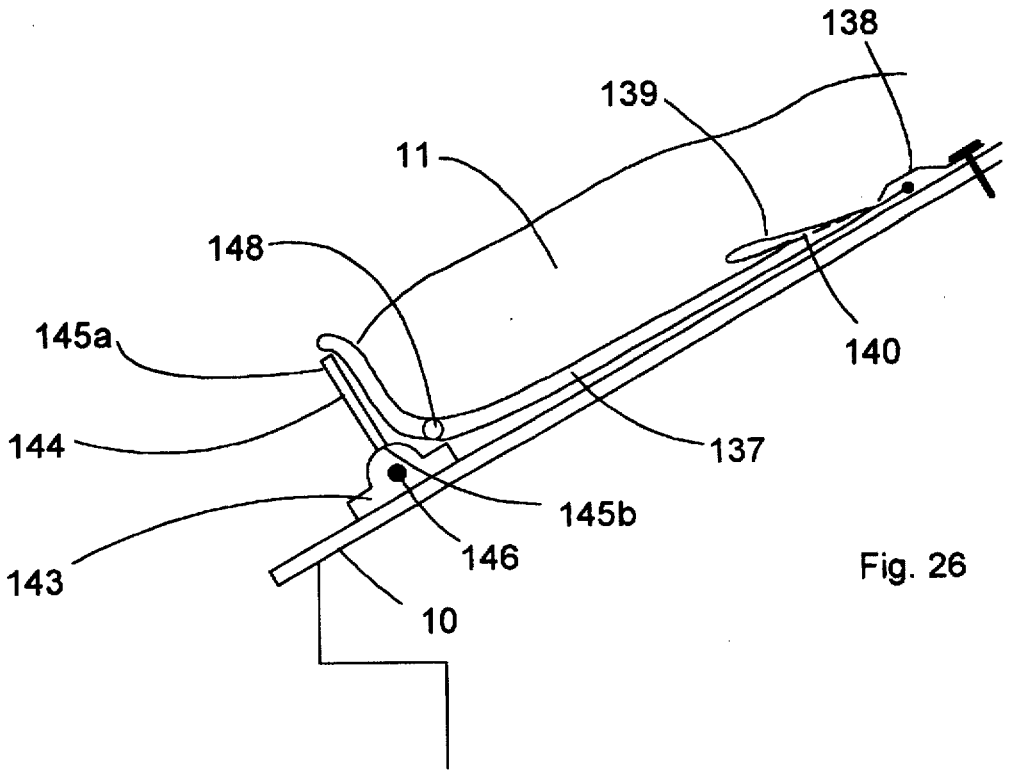
FIG. 26 shows a version of the invention as in FIG. 25 with the addition of a snow brake feature, shown as a rigid structure.

FIG. 26 is an end view of a building showing a version of the invention provided with a substantially rigid snow brake device 144. The mounting frame 138 is fastened directly to the roof 10. At the top of the inflatable membrane 137, extra material 139 is provided for gathering by a bungee cord 140. At the bottom of the roof 10, a snow brake 144 is used to hold back snow from sliding off of roof 10. This configuration of the invention provides the building manager with complete control as to when the snow comes off. The snow brake 144 acts as a gate. When it is up, the snow is held in place. When the snow brake 144 is let down the snow can slide and fall off the roof 10. The expansion of the inflatable membrane 137 provides the control as to exactly when the snow comes off, which is a preferred feature. A mounting plate 143 is equipped so that the snow brake 144 can rotate up and down at a pivot point 146. The snow brake 144 can be manually or electronically controlled. So that the inflatable membrane stays in the proper position, it is attached to the snow brake 144 fence at attachment points 145*a* and 145*b*. The membrane can be inflated with the snow brake 144 fence in the "up" position if desired. A perforated tube 148, that is affixed to the bottom ply of the membrane will help the top ply to be pulled back into position when a vacuum is applied through the perforated tube 148 inside the membrane. It is important to create the gate or dam effect.

Figure 27:
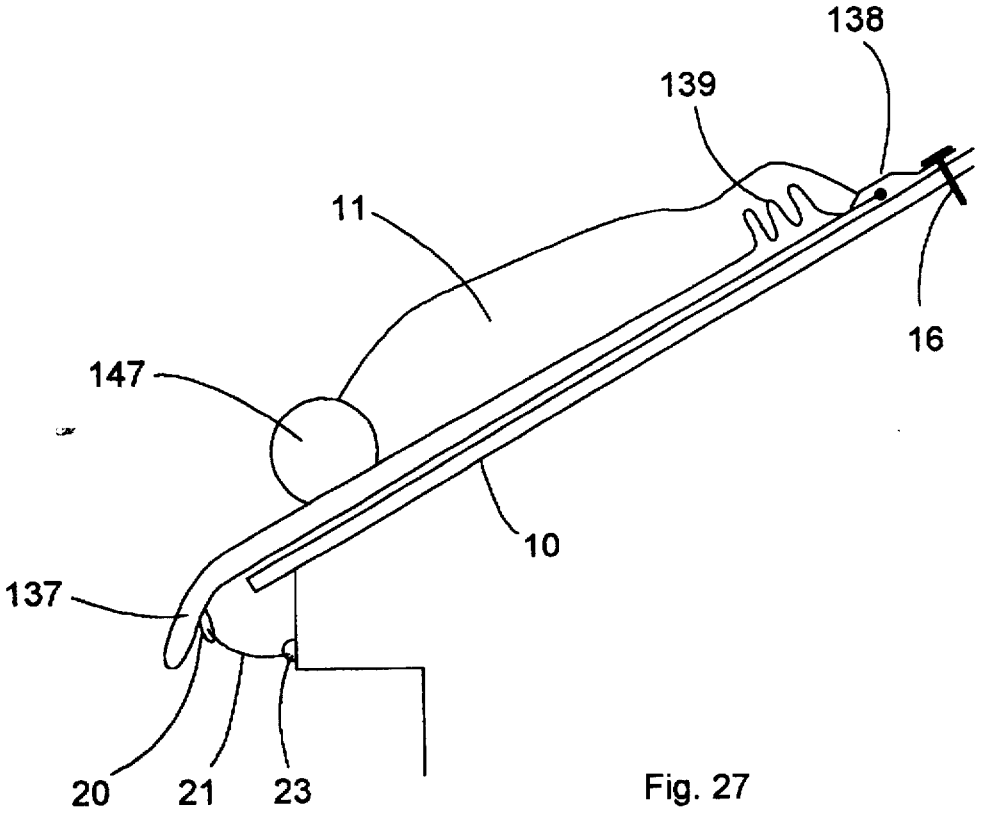
FIG. 27 shows a version with a snow brake feature as in FIG. 25, except that the snow brake is an inflatable tube instead of a rigid structure.

FIG. 27 is an end view of a roof section showing an alternative embodiment of the snow brake mechanism. In this embodiment, an inflatable tube 147 is inflated to act as the snow brake.

Figure 28:
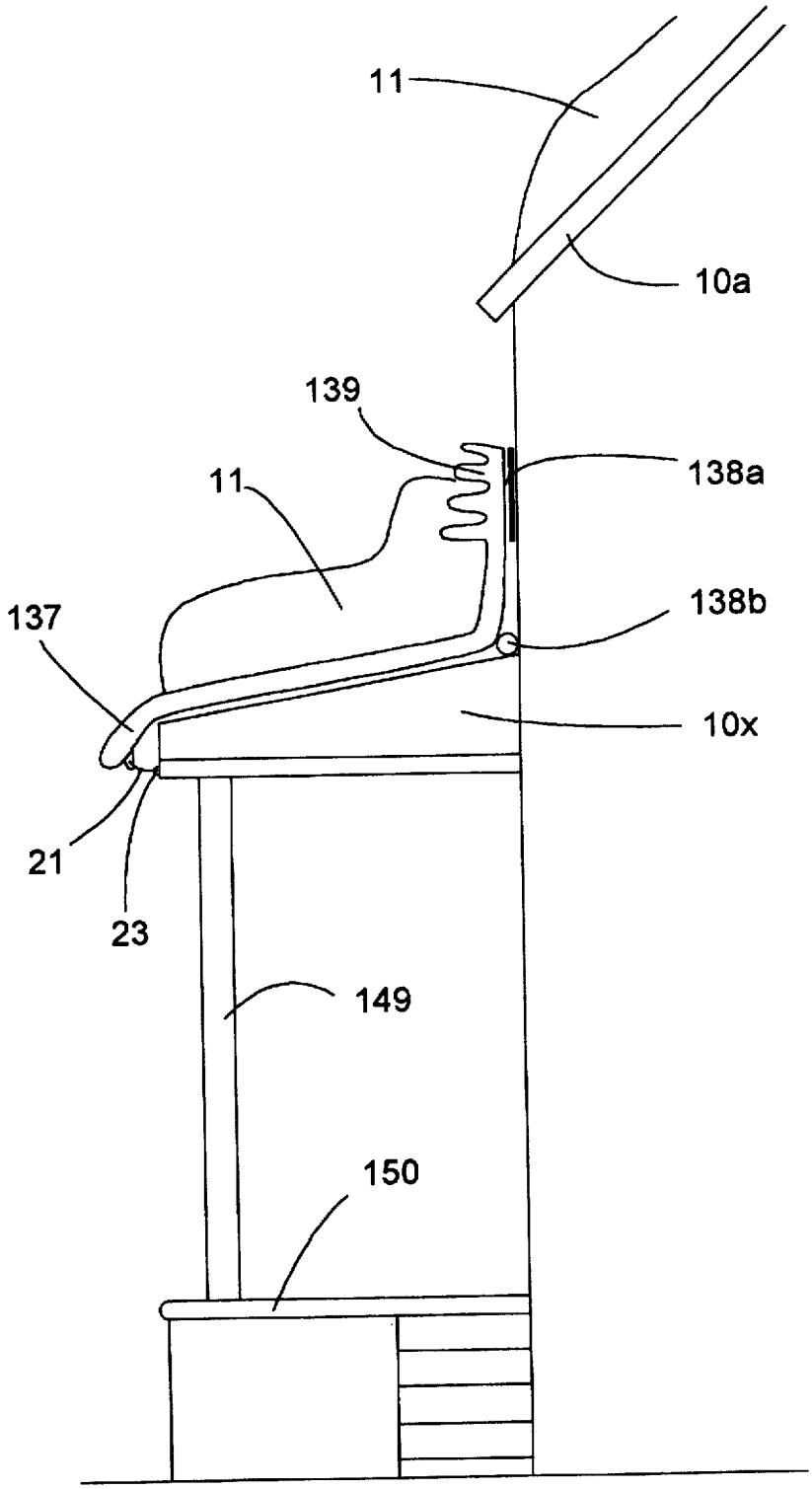
FIG. 28 shows a version of the invention adapted for removing ice and snow from shallow or flat roofs.

FIG. 28 is a side view of a house showing a relatively flat roof 10*x* with an inflatable membrane 137 installed on top. In this configuration, the inflatable membrane 137 is mounted on the vertical sidewall of the building and attached to the building at mounting plates 138*a* and 138*b*. The extra fabric 139 is formed at the top of the inflatable membrane 137 so that it is higher than the snow when it starts inflating so that it can push the snow 11 off the roof and not just lift it up. The porch supports 149 and porch 150 are shown. This configuration of the invention can be used on canopies over loading docks, canopies at movie theaters and all other shallow sloped or flat roof sections of a building. It also provides a leak proof barrier on these roof sections. Typically, a flat shingled roof section will leak long before a steep sloped roof. Many older buildings show the stress of heavy snow loads leading to structural damage or collapse. These snow removal systems can be used on all types of buildings, including domed type buildings and other flat roof construction designs. There is no limit to their size, function and use. Many canopies also suffer from severe ice build up problems that can also be solved by this invention.

Figure 29:
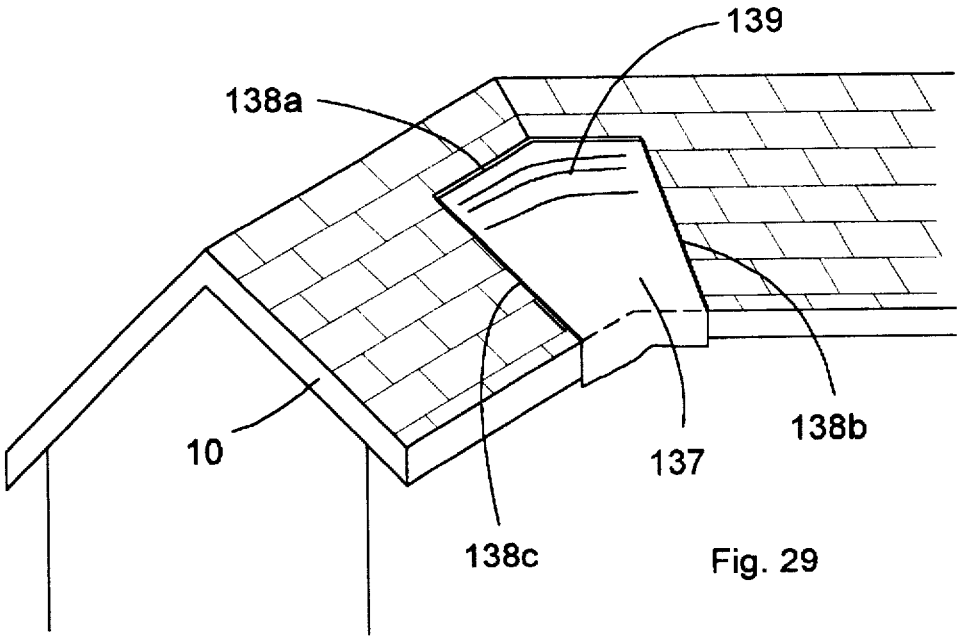
FIG. 29 shows a version of the invention adapted for use in a corner between two roof sections.

FIG. 29 is a bird's eye view of a version of the invention adapted for use in a valley section of a roof. Because the valley section of a roof must handle a disproportionately increased amount of runoff, the icicles, ice dam and ice build up will tend to be very heavy. The top of the inflatable membrane 137 should be mounted much higher on the roof so that it has the ability and size to break up the much heavier ice build up in the valley.

As a result, the valley inflatable membrane 137 component must be held down on all four sides by mounting frames 138*a*, 138*b* and 138*c*, as well as the standard bungee cord hold down system used on the bottom, as described above. Side mounting frame brackets 138*b* and 138*c* are necessary to prevent the wind from blowing underneath the inflatable membrane 137 which could result in damage or cause the sleeve 137 to be ripped off of the roof 10.

As in all of the versions of the invention, this component can be designed for modular use with other the components. Like the other snow removal systems, extra fabric 139 may be used to help push the snow and ice pack off the roof 10. The slope of the roof 10 will help determine if some manual help will be required to get the ice and snow off the roof once it is broken free from the valley section. If the roof 10 is steep, the snow and ice will probably slide off. If the slope of the roof is shallow, some manual effort may be required to pull or push the snow and ice off the roof 10.

Figure 30:
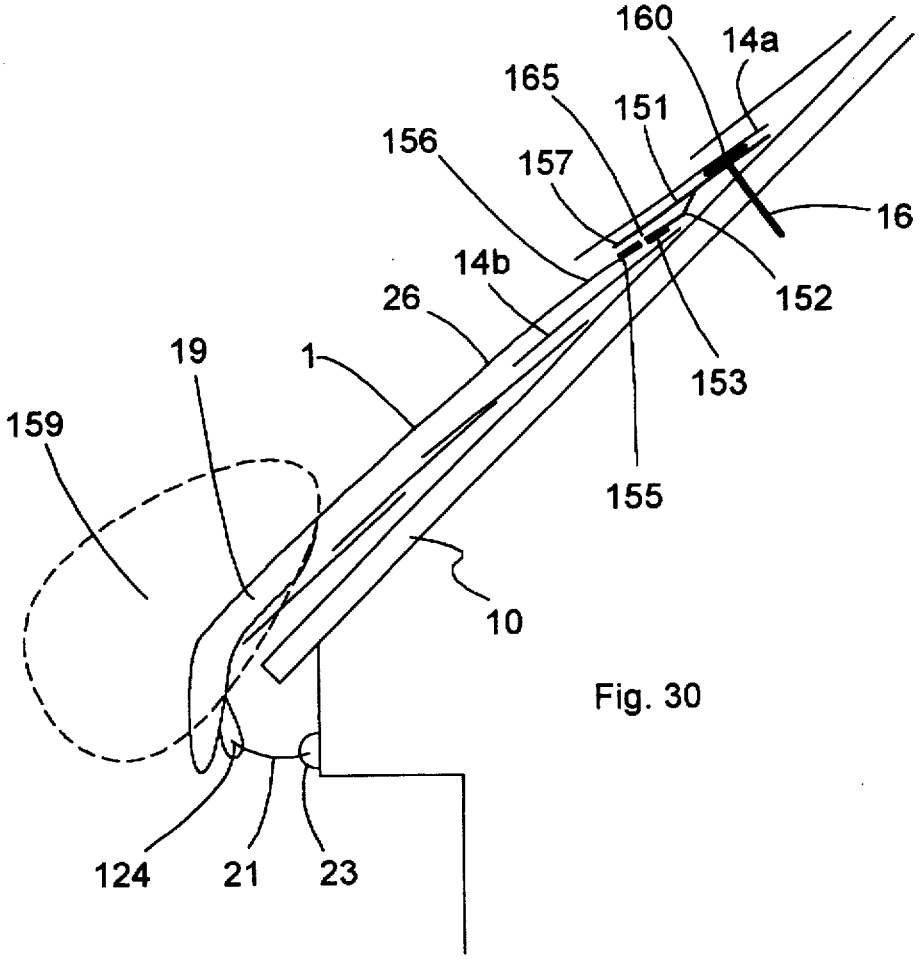
FIG. 30 is an end view of a roof section showing the permanently attached fabric end frame with a zipper connection to hold the inflatable sleeve component in place on a shingled roof.

FIG. 30 is end view of the roof section of a building showing a further embodiment of the invention. In this embodiment, the mounting frame 15 of FIG. 1 is replaced with mounting tab 151. As with previous embodiments, a mounting tab 151 is secured to a roof 10 by a fastener 16 between two shingles 14*a* and 14*b*. Also, in a manner similar to previous embodiments, the top end of the mounting tab 151 extends upward and beyond the opening between the shingles on the same row. As explained earlier, this is important so that water can not get behind the mounting tab 151 and then under the inflatable sleeve 19. The fastener 16 is secured to the roof 10, through the mounting tab 151 in location 160. Mounting tab 151 differs from the mounting plates utilized by the previous embodiments of the invention in that it comprises a zipper assembly 152, which is attached, for example by sewing, on the underside of the mounting tab 151.

The mounting tab end 157 should be lower than the zipper teeth 153 so that the zipper assembly 152 remains protected from possible contamination or clogging due to exposure to the elements. The covering effect of the mounting tab end 157 over the zipper assembly 152 will also provide a cleaner and more atheistic appearance for the system when the inflatable sleeve 19 component is removed during the summer months. During the winter months when the inflatable sleeve 19 component is in operation on the roof 10, the seam or connection 165 that is made when attaching the zipper assembly 155 that is attached to the underside of the top end 156 of the inflatable sleeve 19 to the zipper assembly 152 attached to the mounting tab 151 will also protect the connection 165 from the elements, especially snow, rain, water and ice.

In the preferred embodiment, the bottom end of shingle 14*a* extends lower on the roof line than the bottom end 157 of the mounting tab 151. Thus the roof will look as though no ice removal system is installed during the summer months when the inflatable sleeve 19 is unzipped and removed from the roof. The fastening system on the bottom end of the inflatable sleeve 19 is basically the same for most of the inflatable sleeve 19 designs regardless of the other different types of mounting frames that may be used. A loop 124 holds a shock cord 21 in place on the underside of the inflatable sleeve 19. The shock cord 21 extends and is fastened to a fastener 23 that is attached to the eaves of the roof 10. The inflatable sleeve 19 is shown in an inflated and fully expanded by an state outline 159.

Using a zipper assembly to fasten inflatable sleeve 19 to mounting tab 151 has several distinct advantages. It is much easier to install and remove. The zipper and sleeve assembly can be rolled up instead of having to have long sections stacked on top of one another. The sleeve and zipper assembly can be cut to precise lengths in the field. Furthermore, the use of zippers does not require the manufacture of expensive dies for extruding plastic mounting frames.

Figure 31:
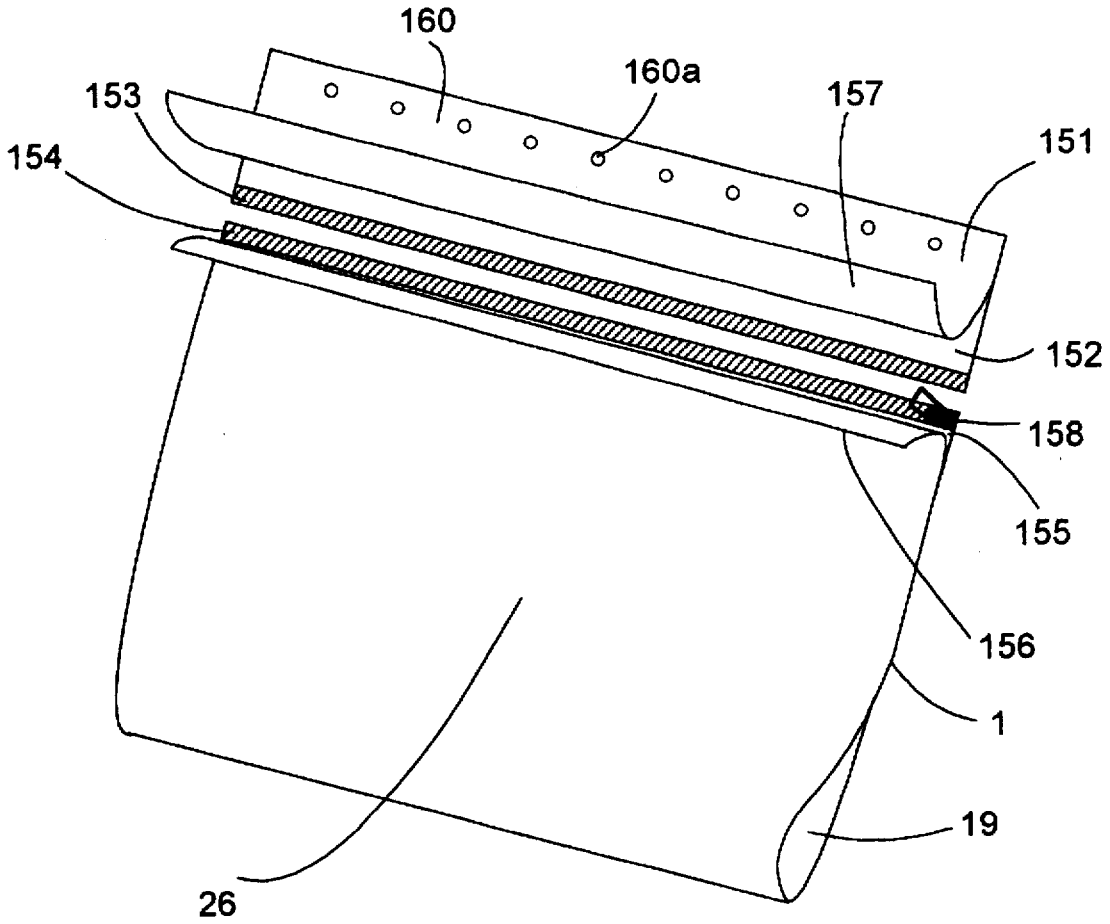
FIG. 31 is an overhead, side view showing the zipper connection between the mounting frame end and the inflatable sleeve.

FIG. 31 shows the arrangement of the zipper assembly 152 attached to the underside of the mounting tab 151. An upper mounting tab extension 157 of the mounting tab 151 is rolled up in this drawing to show detail. Typically, the mounting tab 151 would be fairly stiff and heavy duty even though it may be made of a flexible material like coated fabric. The heavier scrim will allow the mounting tab 151 to provide more overall support when fasteners are secured to roof through the mounting area 160 on the mounting tab 151 as shown by a hole pattern 160. Section 26 of the protective shield 1 can remain as non-inflatable and simply provide protection for the roof section covered underneath. The zipper teeth 153 and 154 are connected together by a zipper fastener 158. For the preferred embodiment, the upper mounting tab extension 157 of the mounting tab 151 should cover the zipper assemblies 152 and 155 and a top end 156 of the protective shield 1.

Figure 32:
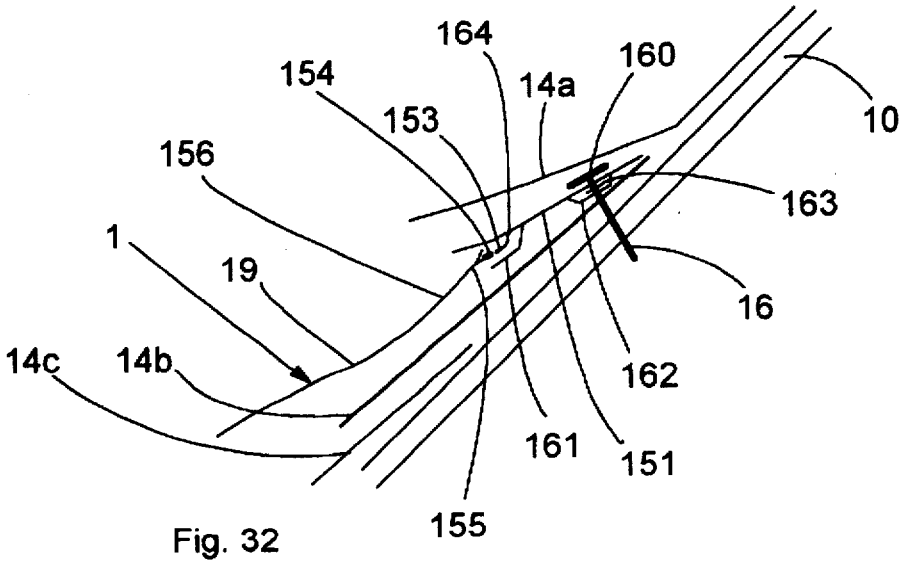
FIG. 32 is an end view of a shingled roof section showing further detail of the zipper connection design between the permanent mounting flap and inflatable sleeve component.

FIG. 32 shows a similar use of the mounting tab 151 using a removable zipper connection with an additional bottom flap extension 161. The flap extension 161 may help keep shingle aggregate material, such as small stone and dust, from clogging up the zipper teeth 153. The shingle 14*a* is shown curved upward, simulating how the mounting tab 151 can be installed by using the fastener 16 to the roof decking 10. The fastener 16 may be a screw, nail, staple, or other fastener well known to those skilled in the art. A flexible housing 162 can be used to hold the stiffener 163 in place when greater support for the mounting tab 151 is required.

The protective shield 1 and the mounting tab 151 assemblies can be manufactured in bulk lengths of several hundred feet or more. For cutting and installing special lengths of each mounting tab assembly 151 and inflatable sleeve assembly 19, the zipper teeth 153 and 154 of each component respectively, can be cut to length and modified using standard zipper stops and clasps for easy and on-site custom installations. The zipper assembly 155 may be sewn to underside of the inflatable sleeve 19 top end 156. A hook and loop fastening system, such as that sold under the trademark "VELCRO", may also be used in place of zippers and other frame connection designs.

Figure 33:
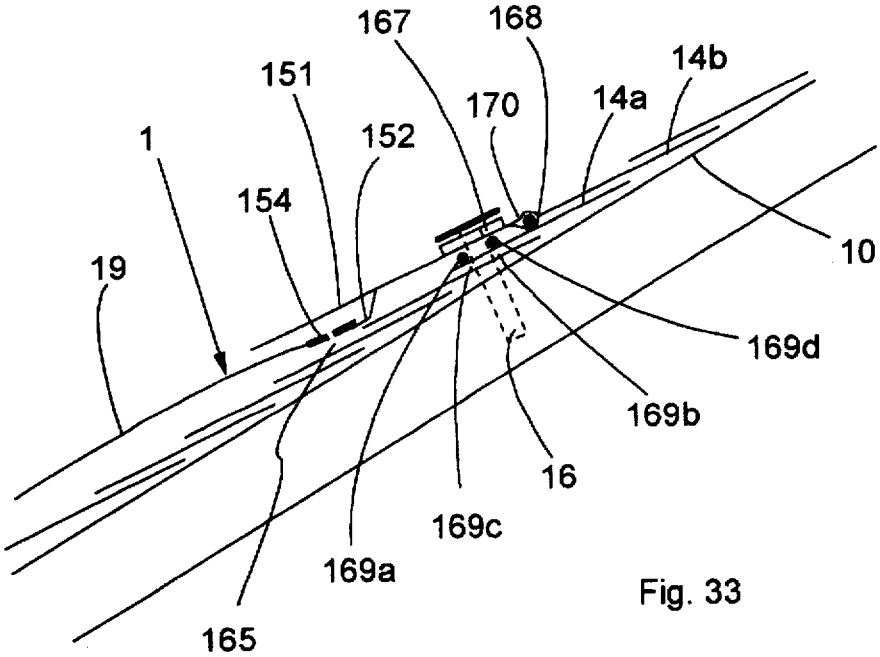
FIG. 33 is an end view of a roof section of a building showing a mounting tab assembly that is mounted on top of a shingle.

FIG. 33 shows the mounting tab 151 mounted directly on top of a row of shingles 14*a* rather than between two rows of shingles 14*a* and 14*b*. Some shingled roof systems do not provide a space between them because they are cemented down on one another. A rigid clamp bar 167 is secured over the mounting tab 151 by fastening a screw 16, or other fastening means, to the roof 10. A waterproof and adhesive roofing tar or caulk placed, for example, at locations 169*a*, 169*b*, 169*c* and 169*d*, ensure that the hole created by the fastener 16 is waterproof.

Additional gasket or caulk material 168 may be placed above and directly against a roped edge 170 assembly of the mounting tab 151 to provide a smooth surface so that water and other debris will not collect in this joint area. A removable connection 165 is created by a zipper assembly 152 which is permanently attached to the underside bottom section of the mounting plate to the zipper assembly 154 that is attached to the top end of the inflatable sleeve 19. The bottom end of the mounting tab 151 extends over the connection 165 and the top end of the protective shield 1 to form a smooth and overlapping surface for the water, snow and other debris to flow across smoothly.

Figure 34:
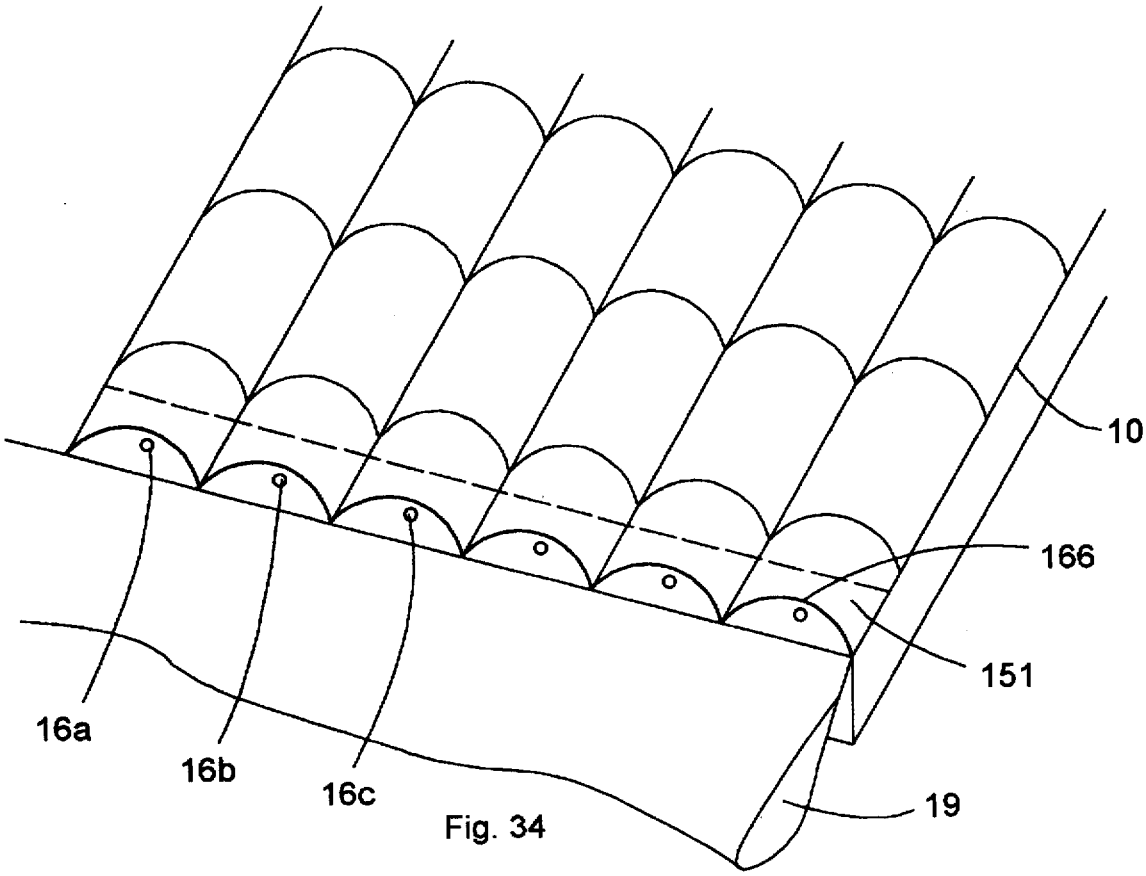
FIG. 34 is a bird's eye view of a roof section of a building with a ceramic tile surface, which is the most common design of roof system in Europe and is shown equipped with an inflatable sleeve system.

FIG. 34 shows the mounting tab 151 of the inflatable sleeve 19 system positioned under a bottom row of tile 166 secured to a roof 10 decking with fasteners placed, for example, at intervals 16*a*, 16*b*, 16*c*, and so on. Any of the different types of top and bottom frame assemblies, accessories, components, blower systems, controls, as shown in the drawings of other embodiments, may be interchangeably combined with this embodiment suitably adapted for tile roofs.

Figure 35:
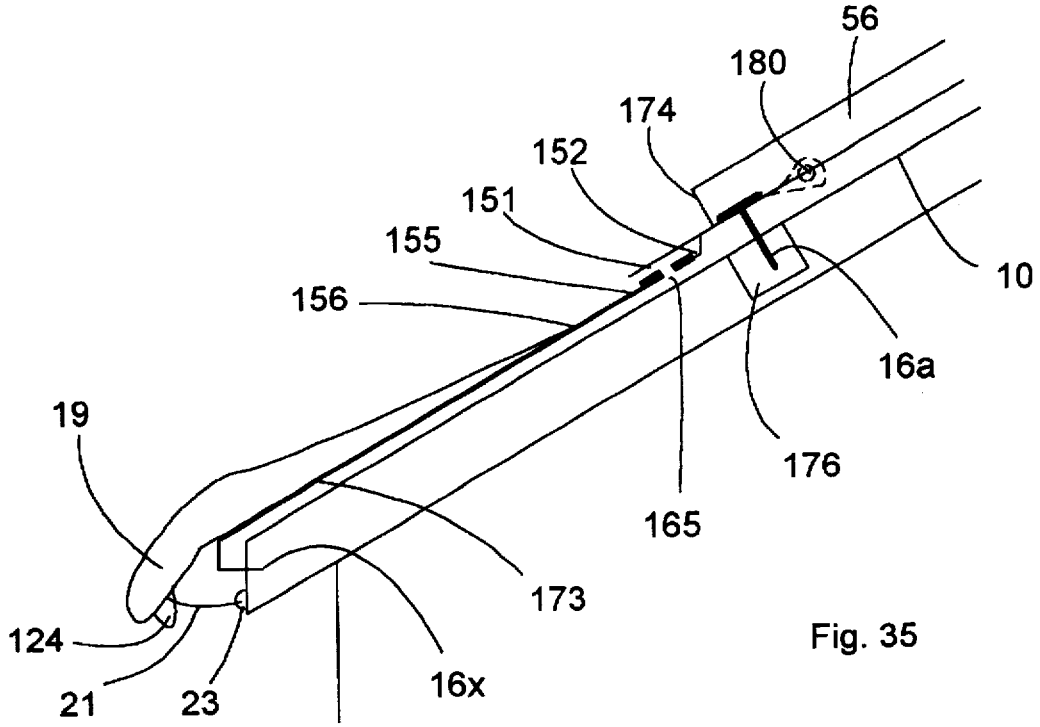
FIG. 35 is an end view of a panel type roof section showing a permanently attached mounting tab with a zipper connection that will enable the inflatable sleeve to be easily installed and removed from the roof as required.

FIG. 35 is an end view of the roof section of a building having a rigid panel-type roof. The bottom section, about three feet (0.9 meters) from the bottom, of the panel type roof decking has been removed so that the inflatable sleeve 19 system can be made ready for installation. A rigid insert panel 173 is placed on the roof beams and slid up and under the existing roof panel 56.

The mounting tab 151 may be made slightly stiffer than the type used on shingled roofs because it will be exposed to the wind and other elements and will not be protected beneath a layer of shingles. The mounting tab 151 should remain somewhat flexible so that it can be lifted up so that the zipper connection 165 can be made between the mounting tab 151 and the inflatable sleeve 19. The zipper assembly 152 may attached to the mounting tab 151 or simply lay underneath it and be attached towards the top end of the insert panel 174 by a fastener 16*a*, or other fastening means well known to those skilled in the art. The mounting tab 151 may be equipped with a roped edge 180 at its upper most top end so that it cannot slip past the joint 174 created where the bottom end of the panel roof 56 and the insert panel 173 meet.

The fastener 16*a* may hold down the bottom end of the panel roof 56, mounting tab 151, and zipper 152. Each component can also be secured independently from the other. The bottom of the insert panel 173 may extend beyond the existing roof line to help provide a better drip edge arrangement. The bottom of the insert panel may be designed with special mounting designs so that a fastener 16X can be used to secure it to the roof 10.

Similar to most of the other configurations mentioned, the loop 124 that holds the shock cord 21 and fastener 23 can be used to hold the bottom of the inflatable sleeve 19 to the roof 10. To properly support the end and hold in place the various components of the system during installation and for permanent use, additional bracing 176 may be required as part of the roof structure, especially in the joint area 174. Caulks and other types of sealants may be used in the joint 174 area.

Figure 36:
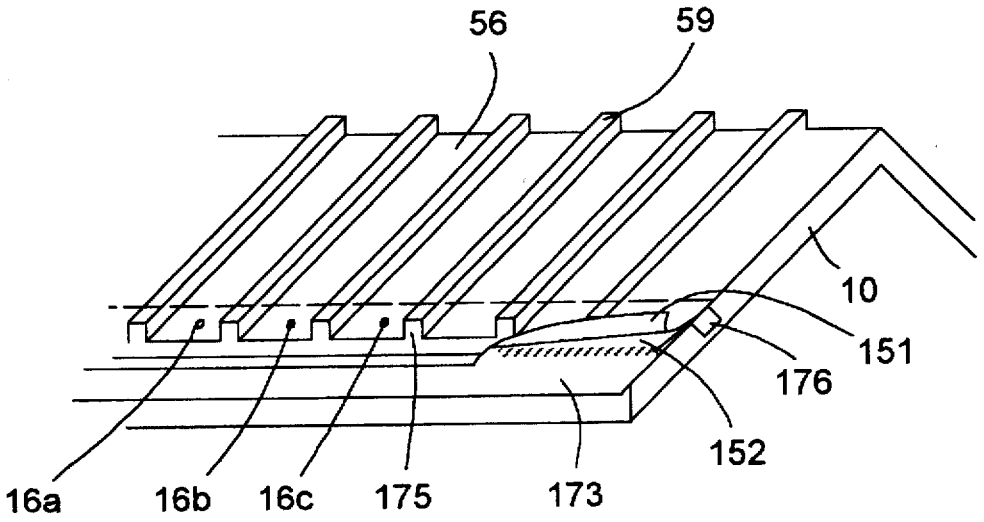
FIG. 36 is an angled front view of a panel type roof section showing a permanently attached mounting tab and zipper connection that will enable the inflatable sleeve to be easily installed and removed from the roof as required.

FIG. 36 is an angled front view showing how the bottom of the roof panel 56 has been cut so that the rigid insert 173 may be installed. With the right end of the mounting tab 151 folded upward, the zipper assembly 152 is visible. The mounting tab 151, rigid insert 173, zipper assembly 152, and the existing panel roof 56 may all be sandwiched together and secured to the roof decking and beams by fasteners 16*a*, 16*b* and 16*c*. Extra roof bracing 176 may be required during this roof modification procedure.

Additional roof bracing may be installed as required, per the design of each roof system. To prevent birds, insects and other debris from getting under the roof, holes around the bracing 175 may be plugged with caulk, plastic foam, or other means.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A device for removing ice and snow from a roof comprising a substantially flexible coated fabric protective shield sealingly attached to a roof surface at a first end to prevent moisture from flowing down said roof and under said shield and a second end extending beyond a bottom edge of said roof.

2. The system for removing ice and snow from a roof as claimed in claim 1 wherein said shield further comprises a release agent to facilitate the sliding of ice and snow off of said roof.

3. The system for removing ice and snow from a roof as claimed in claim 2 wherein said release agent is a silicone spray.

4. The system for removing ice and snow from a roof as claimed in claim 1 further comprising a means for mechanically agitating said protective shield to facilitate the sliding of ice and snow off of said shield.

5. The system for removing ice and snow from a roof as claimed in claim 4 wherein said mechanical agitation means comprises at least one pull cord attached to said second end of said protective shield and extends toward the ground where it can be manipulated by a person in order to shake said protective shield.

6. A system for removing ice and snow from a roof comprising a protective shield and a means for removably retaining said protective shield on said roof wherein said retaining means is sealingly attached to said roof and retains a first end of said shield on said roof to prevent moisture from flowing under said shield and wherein a second end of said shield extends beyond a bottom edge of said roof where said second end of said shield is movably attached to said bottom edge of said roof.

7. The system for removing ice and snow from a roof surface as claimed in claim 6 wherein said protective shield comprises a substantially rigid material.

8. The system for removing ice and snow from a roof surface as claimed in claim 6 wherein said protective shield comprises a substantially flexible material.

9. A system for removing ice and snow from a roof surface comprising: a protective shield having an inflatable sleeve wherein said shield comprises a first end and extends to a second end which extends beyond a bottom edge of said roof and wherein said inflatable sleeve is separated from said first end by a non-inflatable section and extends substantially to the second end of said shield; a means for inflating said inflatable sleeve in order to expand said sleeve, break any ice formed on top of said protective shield and push said ice off of the bottom edge of said roof; a means for removably sealingly attaching said first end of said shield to said roof surface; and a means for movably attaching said second end of said shield to said bottom edge of said roof to allow said inflatable sleeve to expand when it is inflated by said inflation means.

10. The system for removing ice and snow from a roof surface as claimed in claim 9 wherein said means for removably sealingly attaching comprises a mounting frame having clamping assembly configured to hold a roped edge at said first end of said protective shield.

11. The system for removing ice and snow from a roof as claimed in claim 9 wherein said means for removably sealingly attaching comprises a mounting frame sealingly attached to said roof surface having a U-shaped bracket configured to hold a like U-shaped bracket which is attached to said first end of said protective shield.

12. The system for removing ice and snow from a roof as claimed in claim 9 wherein said means for removably sealingly attaching comprises a mounting tab sealingly attached to said roof, said mounting tab having a zipper assembly attached thereto, said zipper assembly removably retaining a zipper attached to said first end of said protective shield.

13. The system for removing ice and snow from a roof as claimed in claim 12 wherein said means for removably sealingly attaching further comprises an upper mounting tab extension, which covers the zipper assembly to protect said zipper assembly from damage.

14. The system for removing ice and snow from a roof as claimed in claim 13 wherein said means for removably sealingly attaching further comprises a bottom flap extension which extends beyond said zipper assembly to protect said zipper assembly from roofing materials.

15. The system for removing ice and snow from a roof as claimed in claim 9 wherein said inflation means comprises a fractional horsepower blower unit capable of producing a pressure in said inflatable sleeve substantially between ¼ and 5 pounds per square inch.

16. The system for removing ice and snow from a roof as claimed in claim 9 further comprising a remote control to activate said inflation means from a safe distance from the edge of said roof.

17. The system for removing ice and snow from a roof as claimed in claim 9 further comprising a timer for activating said inflation means at predetermined time intervals.

18. The system for removing ice and snow from a roof as claimed in claim 9 wherein said second end movable attachment means comprises a shock cord attached to said second end of said protective shield and a plurality of clips attached to said edge of said roof said clips configured to removably retain said shock cord.

19. The system for removing ice and snow from a roof as claimed in claim 9, wherein said means for attaching said first end of said shield to said roof surface comprises a hook and loop fastening system.

20. A device for removing ice and snow from a roof comprising: a protective shield having a first end, a second end, an inflatable sleeve, and a non-inflatable section, said non-inflatable section located intermediate said inflatable sleeve and said first end; a means for removably sealingly attaching said first end of said protective shield on a roof at a position above the edge of said roof, substantially above a position where ice will naturally form on said roof; a means for inflating said inflatable sleeve to break and remove any ice formed on top of said protective shield; and a means for movably securing said second end of said protective shield to the edge of said roof.

21. A method for removing ice and snow from a roof comprising removably sealingly attaching a smooth protective shield onto a roof surface said shield having a first end removably sealing attached to said roof at a distance from the bottom edge of said roof such that natural ice formation will occur on top of said shield and a second end which extends beyond the bottom edge of said roof.

22. A method of removing ice and snow from a roof comprising the steps of: sealingly attaching a protective shield to a roof surface said shield comprising a first end which is removably sealingly attached to said roof surface at a distance up said roof from the bottom edge of said roof, said shield covering an area where ice will form naturally on said roof, said shield further comprising an inflatable sleeve; movably attaching a second end of said protective shield to the lower edge of said roof; and inflating said inflatable sleeve to break and remove ice and snow that has formed on top of said protective shield.

23. A method of removing ice and snow from a roof surface comprising the steps of: installing a mounting frame on a roof said mounting frame configured to removably, sealingly retain a protective shield having an inflatable sleeve on said roof surface; sealingly attaching said protective shield to said mounting frame prior to the winter months; inflating said inflatable sleeve to break and remove ice and snow that has formed on top of said protective shield; removing said protective shield during the non-winter months.

24. The method of removing ice and snow from a roof surface as claimed in claim 23, further comprising the step of coating said shield with a release agent at least once when said shield is removed from said roof.

* * * * *